US011600434B2

(12) United States Patent
Kim et al.

(10) Patent No.: US 11,600,434 B2
(45) Date of Patent: Mar. 7, 2023

(54) POWER INDUCTOR AND MANUFACTURING METHOD THEREFOR

(71) Applicant: MODA-INNOCHIPS CO., LTD., Ansan-Si (KR)

(72) Inventors: Gyeong Tae Kim, Ansan-Si (KR); Tae Geun Seo, Osan-si (KR)

(73) Assignee: MODA-INNOCHIPS CO., LTD.

( * ) Notice: Subject to any disclaimer, the term of this patent is extended or adjusted under 35 U.S.C. 154(b) by 267 days.

(21) Appl. No.: 16/766,286

(22) PCT Filed: Dec. 7, 2018

(86) PCT No.: PCT/KR2018/015561
§ 371 (c)(1),
(2) Date: May 22, 2020

(87) PCT Pub. No.: WO2019/117551
PCT Pub. Date: Jun. 20, 2019

(65) Prior Publication Data

US 2020/0365315 A1 Nov. 19, 2020

(30) Foreign Application Priority Data

Dec. 15, 2017 (KR) ..... 10-2017-0173450

(51) Int. Cl.

| | |
|---|---|
| ***H01F 27/29*** | (2006.01) |
| ***H01F 17/00*** | (2006.01) |
| ***H01F 17/04*** | (2006.01) |
| ***H01F 27/255*** | (2006.01) |
| ***H01F 27/32*** | (2006.01) |
| ***H01F 41/04*** | (2006.01) |

(52) U.S. Cl.
CPC ..... *H01F 27/292* (2013.01); *H01F 17/0013* (2013.01); *H01F 17/04* (2013.01); *H01F 27/255* (2013.01); *H01F 27/324* (2013.01); *H01F 41/046* (2013.01); *H01F 2017/048* (2013.01)

(58) Field of Classification Search
CPC ..... H03H 2001/0085; H03H 7/0115; H01F 2017/002; H01F 2017/0026; H01F 27/292
USPC ..... 333/175, 185
See application file for complete search history.

(56) References Cited

U.S. PATENT DOCUMENTS

| | | | | |
|---|---|---|---|---|
| 2015/0099115 | A1 | 4/2015 | Maeda et al. | |
| 2016/0225517 | A1* | 8/2016 | Choi | H01F 27/292 |
| 2019/0379343 | A1* | 12/2019 | Miyahara | H01G 4/232 |

FOREIGN PATENT DOCUMENTS

| | | | |
|---|---|---|---|
| CN | 102610388 | A | 7/2012 |
| CN | 103093947 | A | 5/2013 |

(Continued)

OTHER PUBLICATIONS

Written Opinion for PCT/KR2018/015561 dated Mar. 14, 2019.
International Search Report for PCT/KR2018/015561 dated Mar. 14, 2019.

*Primary Examiner* — Rakesh B Patel
(74) *Attorney, Agent, or Firm* — Renaissance IP Law Group LLP

(57) ABSTRACT

Disclosed are a power inductor and a method of manufacturing the same. The power inductor includes a body, a coil pattern provided in the body, an external electrode disposed on at least one surface of the body and extending to at least the other surface of the body, which is adjacent thereto, and a coupling layer provided between the body and an extended area of the external electrode.

11 Claims, 15 Drawing Sheets

(56) References Cited

FOREIGN PATENT DOCUMENTS

| | | | |
|---|---|---|---|
| CN | 105428001 | A | 3/2016 |
| CN | 105609233 | A | 5/2016 |
| CN | 105957692 | A | 9/2016 |
| CN | 106816277 | A | 6/2017 |
| CN | 107004493 | A | 8/2017 |
| CN | 107039144 | A | 8/2017 |
| JP | H07201636 | A | 8/1995 |
| JP | 2001155950 | A | 6/2001 |
| JP | 2010129621 | A | 6/2010 |
| JP | 2012094585 | A | 5/2012 |
| JP | 2015065394 | A | 4/2015 |
| JP | 2015095496 | A | 5/2015 |
| KR | 20070032259 | A | 3/2007 |
| KR | 20140038780 | A | 3/2014 |
| KR | 101580411 | B1 | 12/2015 |
| KR | 20160092543 | A | 8/2016 |
| KR | 20160094123 | A | 8/2016 |
| KR | 20170060577 | A | 6/2017 |
| TW | 201735066 | A | 10/2017 |

* cited by examiner

POWER INDUCTOR AND MANUFACTURING METHOD THEREFOR

TECHNICAL FIELD

The present disclosure relates to a power inductor and a method of manufacturing the same, and more particularly, to a power inductor capable of improving a coupling force between a body and an external electrode and a method of manufacturing the same.

BACKGROUND ART

A power inductor, which is a kind of chip components, is generally provided on a power circuit such as a DC-DC converter in portable devices. The power inductor is being increasingly used instead of a conventional wound-type choke coil due to the tendency toward the high frequency and miniaturization of the power circuit. Also, the power inductor is being developed for miniaturization, high current, and low resistance as small-sized and multifunctional portable devices are required.

The typical power inductor is manufactured in the form of a laminated body in which ceramic sheets formed of a plurality of ferrites or a dielectric material having a low dielectric constant are laminated. Here, when a coil pattern is form on each of the ceramic sheets, the coil patterns formed on the ceramic sheets may be connected through a conductive via defined in each of the ceramic sheets and may have a structure in which the coil patterns overlap each other in a vertical direction in which the sheets are laminated. Typically, a body, which is formed by laminating the ceramic sheets, is manufactured by using a magnetic material including a quaternary system of nickel-zinc-copper-iron (Ni—Zn—Cu—Fe).

However, since the magnetic material has a saturation magnetization value less than that of a metal material, high current characteristics, which are required for recent portable devices, may not be realized. Thus, as the body of the power inductor is made of metal powder, the saturation magnetization value may increase relative to a case of the body made of a magnetic material. However, when the body is made of metal, a loss of a material may increase due to increase in loss of eddy current and hysteria in a high frequency.

To reduce the loss of the material, a structure in which the metal powder is insulated by using a polymer has been applied. That is, the body of the power inductor is manufactured by laminating the sheet in which the metal powder and the polymer are mixed. Also, a predetermined base material in which the coil pattern is formed is provided in the body, and an external electrode is provided outside the body so as to be connected to the coil pattern. That is, the power inductor is manufactured such that the body is manufactured by forming the coil pattern on the predetermined base material and laminating and compressing a plurality of sheets thereabove and therebelow, and then the external electrode is formed outside the body.

The external electrode of the power inductor may be formed by applying a conductive paste. That is, the external electrode is formed by applying a metal paste on both sides of the body so as to be connected to the coil pattern. Also, the external electrode may be formed by further forming a plating layer on the metal paste. However, the external electrode formed by using the metal paste may be separated from the body due to a weak coupling force. That is, the power inductor mounted to electronic devices may be applied with a tensile force, and since the power inductor in which the external electrode is formed by using the metal paste has a weak tensile strength, the body and the external electrode may be separated from each other.

RELATED ART DOCUMENT

Korean Publication Patent No. 2007-0032259

DISCLOSURE

Technical Problem

The present disclosure provides a power inductor capable of improving a coupling force between a body and an external electrode to improve a tensile strength and a method of manufacturing the same.

The present disclosure also provides a power inductor capable of improving a coupling force between a body and an extended area of an external electrode and a method of manufacturing the same.

Technical Solution

In accordance with an exemplary embodiment, a power inductor includes: a body; a coil pattern provided in the body; an external electrode disposed on at least one surface of the body and extending to at least the other surface of the body, which is adjacent thereto; and a coupling layer provided between the body and an extended area of the external electrode.

The body may have an inclined edge.

The power inductor may further include a surface insulation layer disposed on at least one area of a surface of the body.

The surface insulation layer may be disposed on the rest surface except for a surface at which the coil pattern is connected to the external electrode.

The coupling layer may be disposed between the surface insulation layer and the extended area of the external electrode.

The coupling layer may contain metal or a metal alloy.

At least a portion of the external electrode may contain the same material as at least one of the coil pattern and the coupling layer.

The external electrode may include a first layer configured to contact the coil pattern and the coupling layer and at least one second layer disposed on the first layer and made of a material different from the first layer.

In accordance with another exemplary embodiment, a method of manufacturing a power inductor includes: preparing a body in which a coil pattern is formed; forming a surface insulation layer on a surface of the body; forming a coupling layer on a predetermined area on the surface insulation layer; removing a portion of the coupling layer and the surface insulation layer to expose the coil pattern; and forming an external electrode on at least one surface of the body so that the external electrode is connected to the coil pattern.

The method may further include forming an edge of the body to be inclined before the forming of the surface insulation layer.

The external electrode may extend from at least one surface of the body to at least one surface, which is adjacent thereto, of the body.

The coupling layer may be formed on an extended area of the external electrode.

At least a portion of the external electrode may be formed by using the same material and the same method as at least one of the coil pattern and the coupling layer.

Advantageous Effects

In the power inductor in accordance with the exemplary embodiments, the external electrode connected to the coil pattern may be made of the same metal as the coil pattern and may be formed in the same method as the coil pattern. That is, at least a partial thickness of the external electrode, which is connected to the coil pattern on the side surface of the body, may be formed in the same method as the coil pattern, e.g., electroplating. Accordingly, the coupling force between the body and the external electrode may be improved, and thus the tensile strength also may be improved Also, the exemplary embodiments may further include the coupling layer provided between the external electrode and the top and bottom surfaces and the front and rear surfaces of the body, to which the external electrode extends, i.e. the bent portion. As the coupling layer is provided, the coupling force of the external electrode may be improved, and accordingly, the tensile strength also may be improved Also, as parylene is applied on the coil pattern, the parylene may be formed on the coil pattern with a uniform thickness, and thus, the insulation property between the body and the coil pattern may be improved.

Also, as at least two base materials each of which has at least one surface on which the coil pattern having a coil shape is formed are provided in the body, the plurality of coils may be formed in one body, and thus the capacity of the power inductor may increase.

The exemplary embodiments may be applied to various kinds of chip components forming the external electrode in addition to the power inductor.

MODE FOR CARRYING OUT THE INVENTION

Hereinafter, specific embodiments will be described in detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

Figure 1:
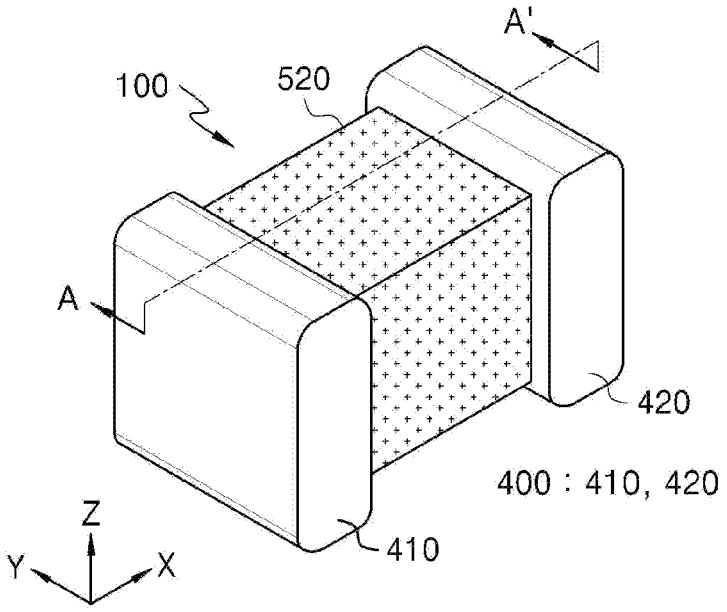
FIG. 1 is a perspective view of a power inductor in accordance with an exemplary embodiment.
Figure 2:
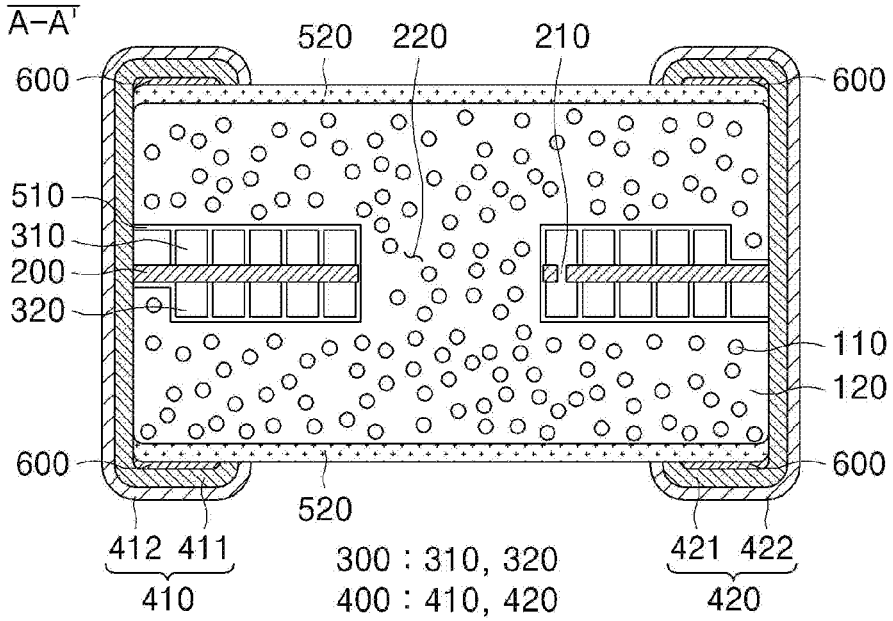
FIGS. 2 and 3 are cross-sectional views taken along line A-A' of FIG. 1 in accordance with an exemplary embodiment and a modified example thereof.
Figure 3:
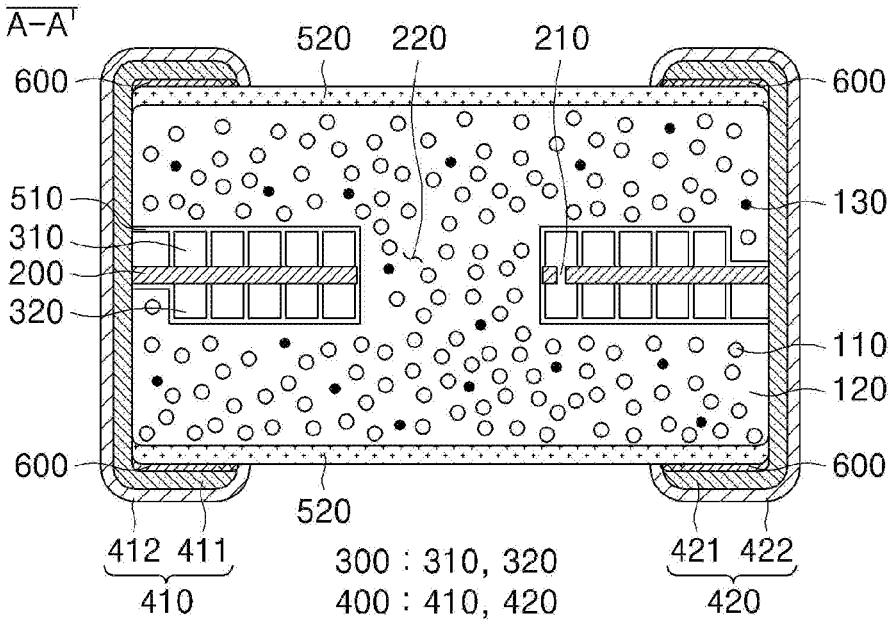
Figure 4:
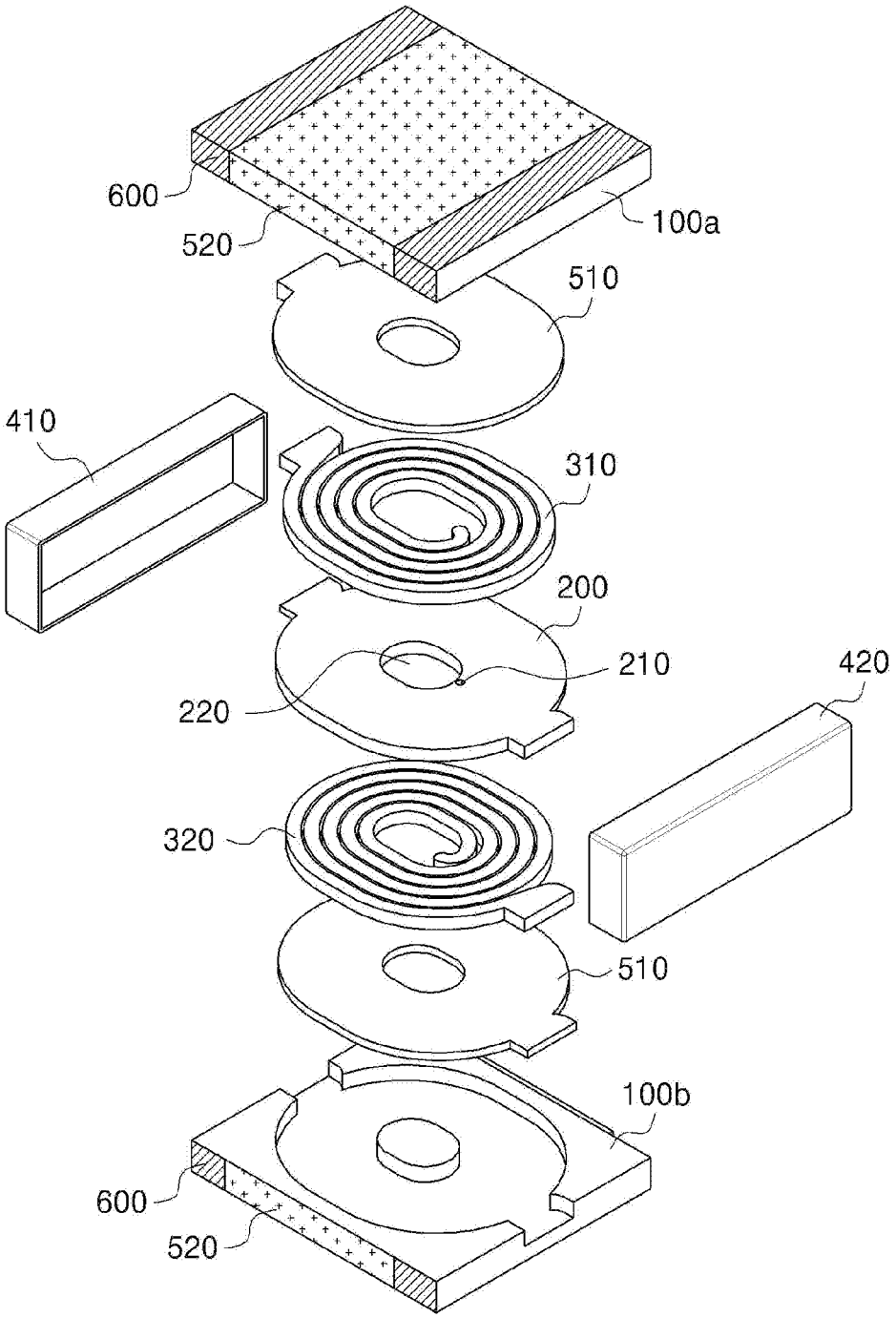
FIGS. 4 and 5 are an exploded perspective view and a partial plan view in accordance with an exemplary embodiment.
Figure 5:
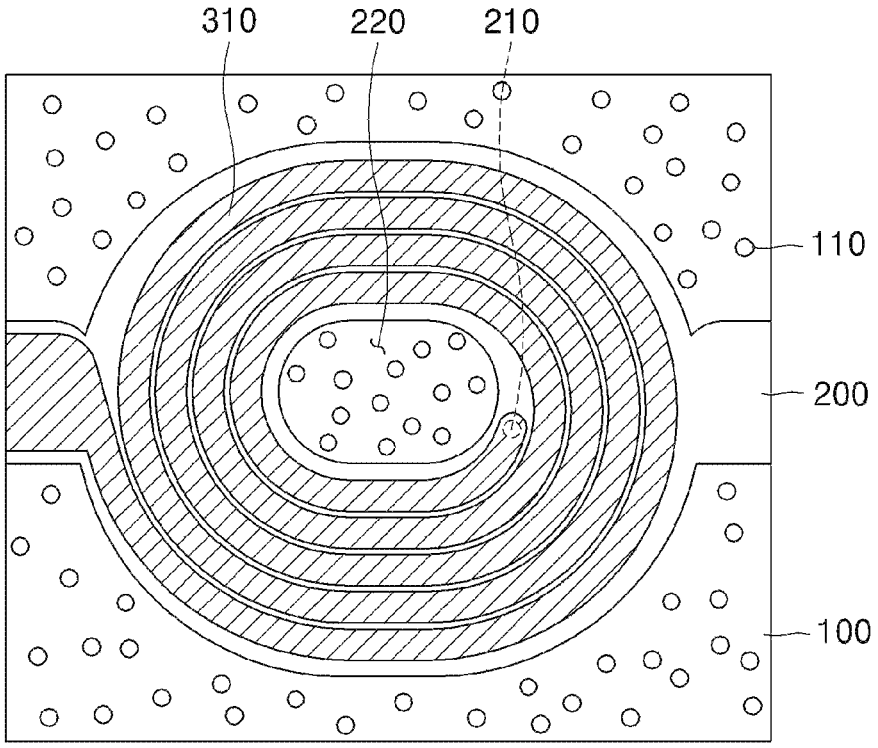
Figure 6:
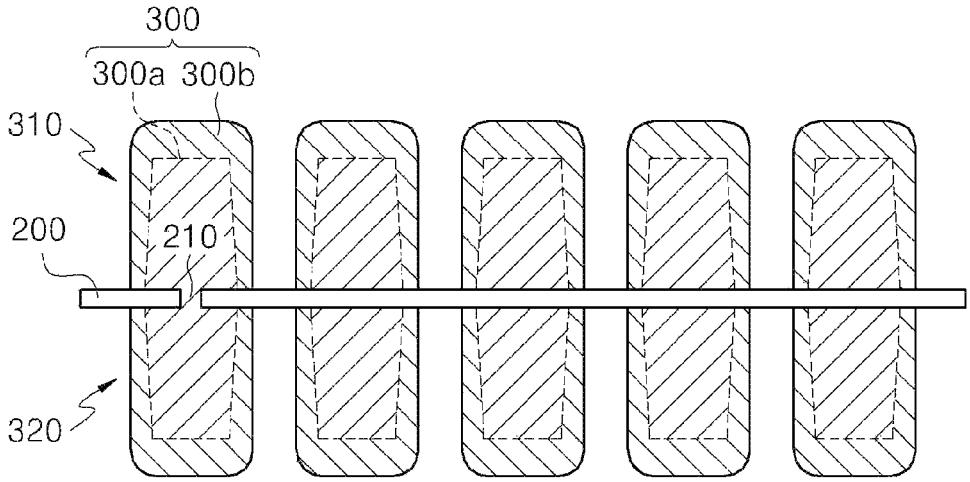
FIGS. 6 to 7 are cross-sectional views of a coil pattern in the power inductor in accordance with an exemplary embodiment.
Figure 7:
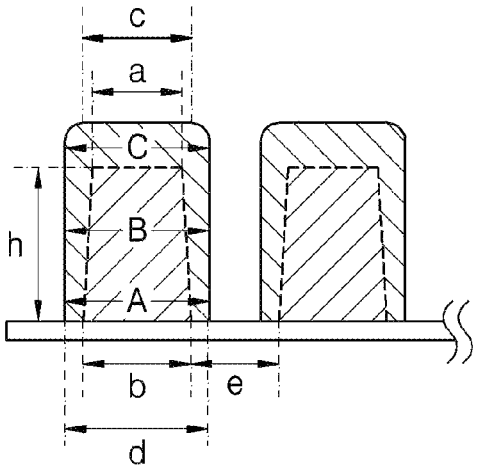
Figure 8:
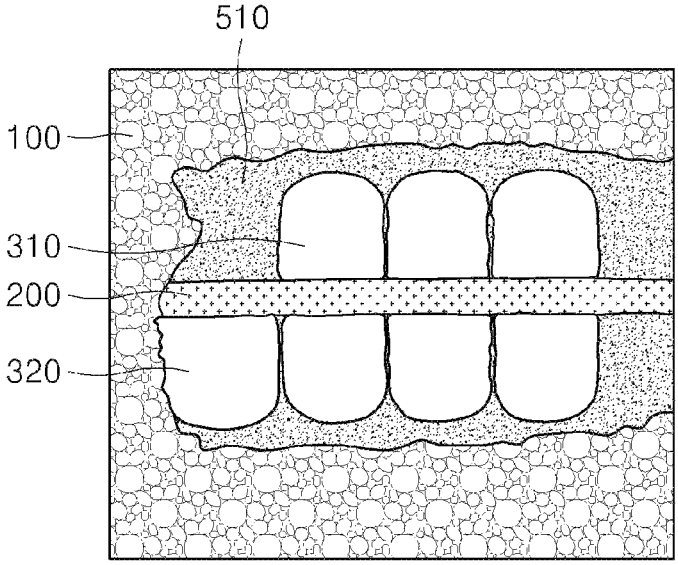
FIGS. 8 and 9 are photographs showing cross-sections of power inductors in accordance with materials of an insulation layers.
Figure 9:
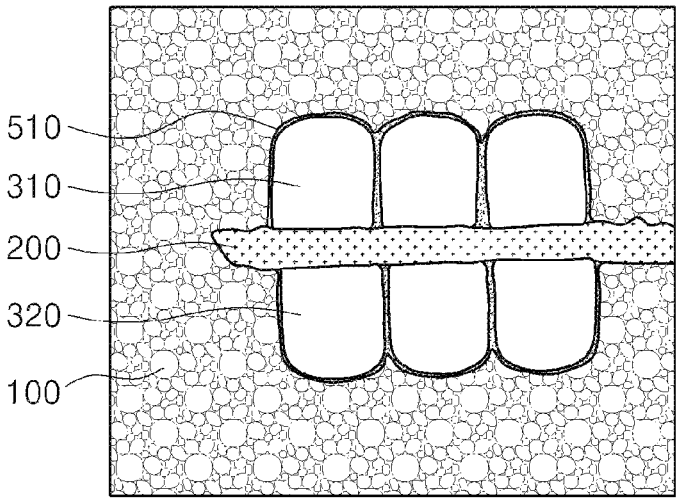
Figure 10:
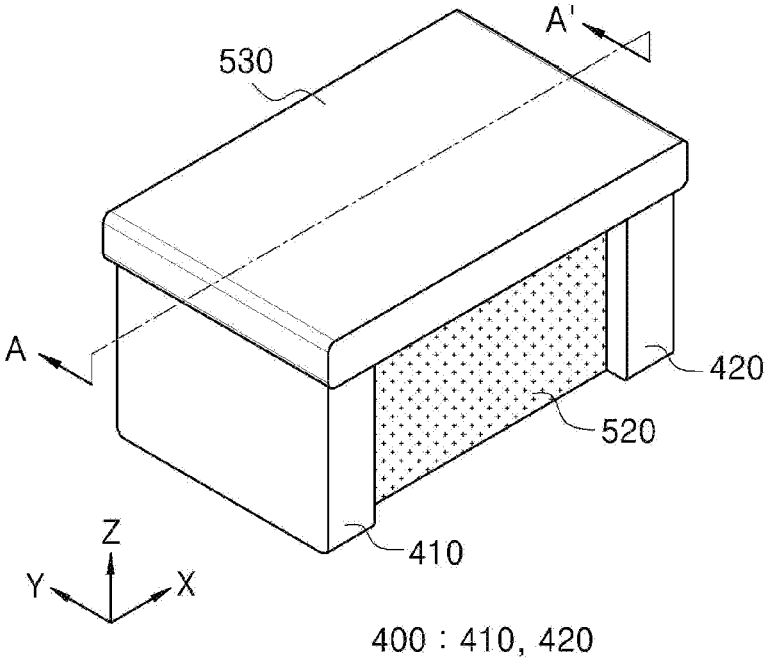
FIG. 10 is a perspective view of a power inductor in accordance with a modified example of an exemplary embodiment.

FIG. 1 is a coupling perspective view illustrating a power inductor in accordance with an exemplary embodiment, and FIGS. 2 and 3 are cross-sectional views taken along line A-A' of FIG. 1 in accordance with an exemplary embodiment and a modified example. FIG. 4 is an exploded perspective view illustrating the power inductor in accordance with an exemplary embodiment, FIG. 5 is a plan view illustrating a base material and a coil pattern, and FIGS. 6 and 7 are cross-sectional views illustrating the base material and the coil pattern for explaining a shape of the coil pattern. Also, FIGS. 8 and 9 are photographs illustrating cross-sections of power inductors in accordance with materials of an insulation layers. Also, FIG. 10 is a perspective view illustrating a power inductor in accordance with a modified example of an exemplary embodiment. The exemplary embodiment may be applied to a chip component forming an external electrode, and the power inductor will be described as an exemplary embodiment.

Referring to FIGS. 1 and 10, a power inductor in accordance with an exemplary embodiment may include: a body 100 (100*a* and 100*b*); at least one base material 200 provided in the body 100; a coil pattern 300 (310 and 320) provided on at least one surface of the base material 200; and external electrodes 400 (410 and 420) disposed outside the body 100. Also, the power inductor may further include an inner insulation layer 510 disposed between the coil pattern 310 and 320 and the body 100 and a surface insulation layer 520 disposed on a surface of the body, on which the external electrode is not disposed. Also, the power inductor may further include a coupling layer 600 disposed on the rest surface of the body 100 except for two surfaces, from which the coil pattern 300 is exposes, between the body 100 and the external electrode 400. As illustrated in FIG. 10, the power inductor may further include a capping insulation layer 530 disposed on a top surface of the body 100.

1. Body

The body 100 may have a hexahedral shape. However, the body 100 may have a polyhedral shape in addition to the hexahedral shape. Also, the body 100 may have a chamfered edge. That is, an edge at which two or three surfaces are adjacent to each other may be formed in an inclined manner. The edge may be formed to have a predetermined inclination instead of a right angle or formed in a rounded manner Here, the inclined or rounded edge may have at least a portion that has a different inclination. The above-described body 100 may contain metal powder 110 and an insulating material 120 as illustrated in FIG. 2 and may further contain a thermal conductive filler 130 as illustrated in FIG. 3.

The metal powder 110 may have a mean particle diameter of approximately 1 μm to approximately 100 μm. Also, the metal powder 110 may use a single kind of or at least two kinds of particles having the same size or a single kind of or at least two kinds of particles having a plurality of sizes. For example, first metal powder having a mean particle diameter of approximately 20 μm to approximately 100 μm, second metal powder having a mean particle diameter of approximately 2 μm to approximately 20 μm, and third metal powder having a mean particle diameter of approximately 1 μm to approximately 10 μm may be mixed to be used. That is, the metal powder 110 may include the first metal powder in which a mean particle diameter or a median value D50 of a particle size distribution is approximately 20 μm to approximately 100 μm, the second metal powder in which a mean particle diameter or a median value D50 of a particle size distribution is approximately 2 μm to approximately 20 μm, and third metal powder in which a mean particle diameter or a median value D50 of a particle size distribution is approximately 1 μm to approximately 10 μm. Here, the first metal powder may be greater than the second metal powder, and the second metal powder may be greater than the third metal powder. Here, the metal powder may be the same kind of powder or different kinds of powder. Also, a mixing ratio of the first, second, and third metal powder may be, e.g., 5 to 9:0.5 to 2.5:0.5 to 2.5, preferably 7:1:2. That is, with respect to the metal powder 110 of approximately 100 wt %, the first metal powder of approximately 50 wt % to approximately 90 wt %, the second metal powder of approximately 5 wt % to approximately 25 wt %, and the third metal powder of approximately 5 wt % to approximately 25 wt % may be mixed. Here, the first metal powder may be contained greater than the second metal powder, and the second metal powder may be contained equal to or less than the third metal powder. Preferably, with respect to the metal powder 110 of approximately 100 wt %, the first metal powder of approximately 70 wt %, the second metal powder of approximately 10 wt %, and the third metal powder of approximately 20 wt % may be mixed. Since the metal powder 110, in which metal powder having at least two, and preferably, three or more mean particle diameters is uniformly mixed, is distributed over the entire body 100, a magnetic permeability may be uniform over the entire body 100. When at least two kinds of metal powder 110 having sizes different from each other is used, a filling rate of the body 100 may increase to maximally realize a capacity. For example, in case of using the metal power having the mean size of approximately 30 μm, a pore may be generated between the metal powder, and thus the filling rate may decrease. However, as the metal power having a size of approximately 3 μm is mixed between the metal powder having a size of approximately 30 μm, the filling rate of the metal powder in the body 110 may increase. The metal powder 110 may use a metal material containing iron (Fe). For example, the metal powder 110 may contain at least one metal selected from the group consisting of iron-nickel (Fe—Ni), iron-nickel-silicon (Fe—Ni—Si), iron-aluminum-silicon (Fe—Al—Si), and iron-aluminum-chrome (Fe—Al—Cr). That is, the metal powder 110 may contain iron to have a magnetic composition or be formed of a metal alloy having magnetic properties to have predetermined magnetic permeability. Also, a surface of the metal powder 110 may be coated with a magnetic material having magnetic permeability different from that of the metal powder 110. For example, the magnetic material may include a metal oxide magnetic material. The metal oxide magnetic material may include at least one selected from the group consisting of a nickel oxide magnetic material, a zinc oxide magnetic material, a copper oxide magnetic material, a magnesium oxide magnetic material, a cobalt oxide magnetic material, a barium oxide magnetic material, and a nickel-zinc-copper oxide magnetic material. That is, the magnetic material applied on the surface of the metal powder 110 may be formed of a metal oxide containing iron and preferably have the magnetic permeability greater than that of the metal powder 110. Since the metal powder 110 has a magnetic property, when the metal powder 110 contacts each other, insulation therebetween may be broken, and short-circuit may occur. Thus, the surface of the metal powder 110 may be coated with at least one insulating material. For example, the surface of the metal powder 110 may be coated with an oxide or an insulating polymer material such as parylene. Here, the parylene is preferred. The parylene may be applied with a thickness of approximately 1 μm to approximately 10 μm. Here, when the parylene is applied with a thickness less than approximately 1 μm, an insulation effect of the metal powder 110 may be degraded, and when the parylene is applied with a thickness greater than approximately 10 μm, as a size of the metal powder 110 increases, and the distribution of the metal powder 110 in the body 100 decrease, the magnetic permeability may decrease. Also, the surface of the metal powder 110 may be coated with various insulating polymer materials in addition to the parylene. The oxide, which is applied to the metal powder 110, may be formed by oxidizing the metal powder 110. Alternatively, the metal powder 110 may be coated with at least one selected from the group consisting of $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$. Here, the metal powder 110 may be coated with an oxide having a double structure, e.g., a double structure of the oxide and the polymer material. Alternatively, the surface of the metal powder 110 may be coated with the magnetic material and then coated with an insulating material. As the surface of the metal powder 110 is coated with the insulating material, the short-circuit due to the contact between the metal powder 110 may be prevented. Here, the metal powder 110 is coated with the oxide or the insulating polymer material or the double structure of the magnetic material and the insulating material with a thickness of approximately 1 μm to approximately 10 μm.

The insulating material 120 may be mixed with the metal powder 110 to insulate the metal power 110 from each other. That is, the metal powder 110 may increase in loss of eddy current and hysteria in a high frequency to cause a loss of the material. To reduce the loss of the material, the insulating material 120 may be contained to insulate the metal powder 110 from each other. The insulating material 120 may include at least one selected from the group consisting of epoxy, polyimide, and liquid crystalline polymer (LCP). However, the exemplary embodiment is not limited thereto. Also, the insulating material 120 may be made of a thermosetting resin to provide an insulation property between the metal powder 110. For example, the thermosetting resin may include at least one selected from the group consisting of a novolac epoxy resin, a phenoxy-type epoxy resin, a BPA-type epoxy resin, a BPF-type epoxy resin, a hydrogenated BPA epoxy resin, a dimer acid modified epoxy resin, an urethane modified epoxy resin, a rubber modified epoxy resin, and a DCPD-type epoxy resin. Here, the insulating material 120 may be contained at a content of approximately 2.0 wt % to approximately 5.0 wt % on the basis of approximately 100 wt % of the metal powder 110. However, when the content of the insulating material 120 increases, as a volume fraction of the metal powder 110 decreases, the effect of increasing the saturation magnetization value may not be appropriately realized, and the magnetic permeability of the body 100 may decrease. On the contrary, when the content of the insulating material 120 decreases, as a strong acid or alkaline solution, which is used in a process of manufacturing the inductor, is introduced into the metal powder 110, inductance characteristics may be reduced. Thus, the insulating material 120 may be contained within a range in which the saturation magnetization value and the inductance of the metal powder 110 are not reduced.

However, there is a limitation in which the power inductor manufactured by using the metal powder 110 and the insulating material 120 is reduced in inductance as a temperature increases. That is, a limitation, the power inductor increases in temperature due to heat generation of an electronic device applied with the power inductor, and accordingly, the inductance is reduced while the metal power 110 forming the body of the power inductor is heated, is generated. To resolve the above-described limitation in which the body 100 is heated by external heat, the body 100 may include the thermal conductive filler 130. That is, when the metal powder 110 of the body 100 is heated by external heat, as the thermal conductive filler 130 is contained, the heat of the metal powder 110 may be discharged to the outside. Although the thermal conductive filler 130 may include at least one selected from the group consisting of MgO, AlN, a carbon-based material, a nickel-based material, and a manganese-based material, the exemplary embodiment is not limited thereto. Here, the carbon-based material may include carbon and have various shapes. For example, the carbon-based material may include graphite, carbon black, graphene, graphite, or the like. Also, the nickel-based ferrite may include NiO, ZnO, and CuO—$Fe_2O_3$, and the manganese-based ferrite may include MnO, ZnO, and CuO—$Fe_2O_3$. As the thermal conductive filler is made of a ferrite material, increase or decrease in magnetic permeability may be preferably prevented. The above-described thermal conductive filler 130 may be distributed and contained in the insulating material 120 in the form of powder. Also, the thermal conductive filler 130 may be contained at a content of approximately 0.5 wt % to approximately 3 wt % on the basis of approximately 100 wt % of the metal powder 110. When the thermal conductive filler 130 has a content less than the above-described range, a heat discharge effect may be achieved, and when thermal conductive filler 130 has a content greater than the above-described range, as the content of the metal powder 110 decreases, the magnetic permeability of the body 100 is reduced. Also, the thermal conductive filler 130 may have a size of, e.g., approximately 0.5 μm to approximately 100 μm. That is, the thermal conductive filler 130 may have the same size as or a size less than the metal powder 110. The thermal conductive filler 130 may be adjusted in heat discharge effect in accordance with the size and content thereof. For example, as the size and content of the thermal conductive filler 130 increases, the heat discharge effect may increase. The body 100 may be manufactured by laminating a plurality of sheets, which are made of a material including the metal powder 110, the insulating material 120, and the thermal conductive filler 130. Here, when the plurality of sheets are laminated to manufacture the body 100, the thermal conductive filler 130 of each of the sheets may be different in content. For example, as the thermal conductive filler 130 is gradually away upward and downward from the center of the base material 200, the content of the thermal conductive filler 130 within the sheet may gradually increase. That is, the content of the thermal conductive filler 130 may be different in a vertical direction, i.e., a Z-direction. Also, the content of the thermal conductive filler 130 may be different in a horizontal direction, i.e., at least one of a X-direction and a Y-direction. That is, the content of the thermal conductive filler 130 may be different within the same sheet. Also, the body 100 may be manufactured by applying, as necessary, various methods such as a method of printing a paste, which is made of the metal powder 110, the insulating material 120, and the thermal conductive filler 130, with a predetermined thickness or a method of pressing the paste into a frame. Here, the number of laminated sheets or the thickness of the paste printed with a predetermined thickness so as to form the body 100 may be appropriately determined in consideration of electrical characteristics such as inductance required for the power inductor. In the exemplary embodiment, the body 100 further includes the thermal conductive filler as a modified example. Although the thermal conductive filler is not mentioned in another exemplary embodiment hereinafter, it will be understood that the body 100 further includes the thermal conductive filler.

Bodies 100*a* and 100*b*, which are disposed above and below the base material 200 with the base material 200 therebetween, may be connected to each other through the base material 200. That is, a portion of the base material may be removed, and a portion of the body 100 may be filled in the removed portion. As at least a portion of the base material 200 is removed, and the body is filled in the removed portion, an area of the base material 200 decreases, and a ratio of the body 100 increases in the same volume. Thus, the magnetic permeability of the power inductor may increase.

2. Base Material

The base material 200 may be provided in the body 100. For example, the base material 200 may be provided in the body 100 in a longitudinal direction of the body 100, i.e., a direction toward the external electrode 400. Here, at least one base material 200 may be provided, for example, at least two base materials 200 may be spaced a predetermined distance from each other in a direction perpendicular to a direction in which the external electrode 400 is disposed, e.g., in a vertical direction. Alternatively, two or more base materials may be arranged in a direction in which the external electrode 400 is provided. For example, the base material 200 may be manufactured by using a copper clad lamination (CCL) or a metal magnetic material. Here, as the base material 200 is formed of the metal magnetic material, the magnetic permeability may increase, and the capacity may be easily realized. That is, the CCL is manufactured by bonding a copper foil to a glass reinforced fiber, and since the CCL does not have the magnetic permeability, the power inductor may be degraded in magnetic permeability. However, when the base material 200 is made of the metal magnetic material, since the metal magnetic material has the magnetic permeability, the power inductor may not be degraded in magnetic permeability. The base material 200 using the metal magnetic material may be manufactured by bonding a copper foil to a plate having a predetermined thickness, which is made of metal containing iron, e.g., at least one metal selected from the group consisting of iron-nickel (Fe—Ni), iron-nickel-silicon (Fe—Ni—Si), iron-aluminium-silicon (Fe—Al—Si), and iron-aluminium-chrome (Fe—Al—Cr). That is, the base material 200 may be manufactured such that an alloy made of at least one metal containing iron is manufactured into a plate shape having a predetermined thickness, and then a copper foil is bonded to at least one surface of the metal plate.

Also, at least one conductive via 210 may be defined in a predetermined area of the base material 200, and the coil patterns 310 and 320 disposed above and below the base material 200 may be electrically connected to each other through the conductive via 210. The conductive via 210 may be formed through a method, in which a via (not shown) passing through the base material 200 in a thickness direction is formed in the base material 200, and then the paste may be filled into the via. Here, at least one of the coil patterns 310 and 320 may be grown from the conductive via 210, and accordingly, the conductive via 210 and at least one of the coil patterns 310 and 320 may be integrated with each other. Also, at least a portion of the base material 200 may be removed. That is, at least a portion of the base material 200 may be removed or may not be removed. Preferably, as illustrated in FIGS. 4 and 5, the rest area of the base material 200 except for an area overlapping the coil patterns 310 and 320 may be removed. For example, an area of the base material 200, which is disposed inside the coil patterns 310 and 320 each having a spiral shape, may be removed to define a through-hole 220, or an area of the base material 200, which is disposed outside the coil patterns 310 and 320, may be removed. That is, the base material 200 may have, e.g., a racetrack shape along an outer shape of each of the coil patterns 310 and 320, and an area facing the external electrode 400 may have a linear shape along a shape of an end of each of the coil patterns 310 and 320. Accordingly, the outer side of the base material 200 may have a curved shape with respect to an edge of the body 100. As illustrated in FIG. 5, the body 100 may be filled in the portion from which the base material 200 is removed. That is, an upper body 100*a* and a lower body 100*b* may be connected to each other through the removed area including the through-hole 220 of the base material 200. Also, when the base material 200 is made of the metal magnetic material, the base material 200 may contact the metal powder 110. To resolve the above-described limitation, an inner insulation layer 510 such as parylene may be provided on a side surface of the base material 200. For example, the inner insulation layer 510 may be provided on a side surface of the through-hole 220 and an outer surface of the base material 200. Here, the base material 200 may have a width greater than that of each of the coil patterns 310 and 320. For example, the base material 200 may be remained with a predetermined width vertically below the coil patterns 310 and 320. For example the base material 200 may protrude by approximately 0.3 μm from the coil patterns 310 and 320. As an area of the base material 200, which is disposed on the inner side and outer side of the coil patterns 310 and 320 is removed, the base material 200 may have an area less than a cross-section of the body 100. For example, when an area of the cross-section of the body 100 is approximately 100, the base material 200 may have an area ratio of approximately 40 to approximately 80. When the area ratio of the base material 200 is high, the magnetic permeability of the body may decrease, and when the area ratio of the base material 200 is low, a formed area of the coil patterns 310 and 320 may decrease Thus, the area ratio of the base material 200 may be adjusted in consideration of the magnetic permeability of the body 100, the line width and the number of turn of each of the coil patterns 310 and 320, or the like.

3. Coil Pattern

The coil pattern 300 (310, 320) may be disposed on at least one surface, preferably, both surfaces of the base material 200. Each of the coil patterns 310 and 320 may have a spiral shape from a predetermined area of the base material 200, e.g., from a central portion thereof in an outward direction, and the two coil patterns 310 and 320 disposed on the base material 200 may be connected to each other to form one coil. That is, the coil patterns 310 and 320 may have a spiral shape formed on the central portion of the base material 200 from the outside of the through-hole 220 and may be connected to each other through the conductive via 210 defined in the base material 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. Each of the coil patterns 310 and 320 may have an end that has a linear shape extending to the outside. The end may extend along a central portion of a short side of the body 100. As illustrated in FIGS. 4 and 5, an area of each of the coil patterns 310 and 320, which contacts the external electrode 400, may have a width greater than other areas. As a portion of each of the coil patterns 310 and 320, i.e., a withdrawal portion, has a wider width, a contact area between the coil pattern 310 and 320 and the external electrode 400 may increase, and accordingly, resistance may decrease. Alternatively, each of the coil patterns 310 and 320 may extend in a width direction of the external electrode 400 on one area on which the external electrode 400 is provided. Here, the end of each of the coil patterns 310 and 320, i.e., the withdrawal portion withdrawn toward the external electrode 400, may have a linear shape toward the central portion of the side surface of the body 100.

The coil patterns 310 and 320 may be electrically connected to each other through the conductive via 210 defined in the base material 200. The coil patterns 310 and 320 may be formed through various methods such as, e.g., thick-film printing, coating, deposition, plating, and sputtering. Here, the plating method is preferred. Also, the coil patterns 310 and 320 and the conductive via 210 may be made of a material including at least one of silver (Ag), copper (Cu), and a copper alloy. However, the exemplary embodiment is not limited thereto. When the coil patterns 310 and 320 are formed through the plating process, a coupling layer, e.g., a copper layer, is formed on the base material 200 through the plating process and then patterned through a lithography process. That is, the copper layer may be formed by using the copper foil disposed on the surface of the base material 200 as a seed layer and then patterned to form the coil patterns 310 and 320. Alternatively, a photosensitive-film pattern having a predetermined shape may be formed on the base material 200, then the plating process may be performed to grow the coupling layer from the exposed surface of the base material 200, and then the photosensitive-film is removed, thereby forming the coil patterns 310 and 320 each having a predetermined shape. Also, each of the coil patterns 310 and 320 may be formed with a multilayer structure. That is, a plurality of coil patterns may be further disposed above the coil pattern 310 disposed above the base material 200, and a plurality of coil patterns may be further disposed below the coil pattern 320 disposed below the base material 200. When the coil patterns 310 and 320 are formed with the multilayer structure, an insulation layer may be provided between a lower layer and an upper layer. Then, a conductive via (not shown) may be defined in the insulation layer to connect the multilayered coil patterns to each other. Each of the coil patterns 310 and 320 may have a height that is approximately 2.5 times greater than a thickness of the base material 200. For example, the base material 200 has a thickness of approximately 10 μm to approximately 50 μm, and each of the coil patterns 310 and 320 may have a height of approximately 50 μm to approximately 300 μm.

Also, each of the coil patterns 310 and 320 in accordance with an exemplary embodiment may have a double structure. That is, as illustrated in FIG. 6, the coil pattern may include a first plating layer 300*a* and a second plating layer 300*b* covering the first plating layer 300*a*. Here, the second plating layer 300*b* covers top and side surfaces of the first plating layer 300*a*. The second plating layer 300*b* may have a thickness on the top surface greater than that on the side surface of the first plating layer 300*a*. The first plating layer 300*a* may have a predetermined inclination on the side surface thereof, and the second plating layer 300*b* may have an inclination less than that of the side surface of the first plating layer 300*a*. That is, the side surface of the first plating layer 300*a* has an obtuse angle from the surface of the base material 200, which is disposed outside the first plating layer 300*a*, and the second plating layer 300*b* may have an angle less than the first plating layer 300*a*, preferably a right angle. As illustrated in FIG. 7, the first plating layer 300*a* may have a ratio between a width a of the top surface and a width b of the bottom surface to be 0.2:1 to 0.9:1, preferably 0.4:1 to 0.8:1. Also, the first plating layer 300*a* may have a ratio between the width b and a height to be 1:0.7 to 1:4, preferably 1:1 to 1:2. That is, the first plating layer 300*a* may have a width that gradually decreases from the bottom surface to the top surface, and accordingly, the side surface may have a predetermined inclination. A primary plating process may be performed, and then an etching process may be performed so that the first plating layer 300*a* has a predetermined inclination. Also, the second plating layer 300*b* covering the first plating layer 300*a* has an approximately rectangular shape in which a side surface is preferably vertically formed and a small rounded portion is formed between the top surface and the side surface. Here, the shape of the second plating layer 300*b* may be determined in accordance with a ratio between the width a of the top surface and the width b of the bottom surface of the first plating layer 300*a*, i.e., a ratio of a:b. For example, as the ratio a:b between the width a of the top surface and the width b of the bottom surface of the first plating layer 300*a* increases, the ratio between a width c of the top surface and a width d of the bottom surface of the second plating layer 300*b* increases. However, when the ratio a:b between the width a of the top surface and the width b of the bottom surface of the first plating layer 300*a* is greater than 0.9:1, the second plating layer 300*b* may be formed such that the width of the bottom surface is greater than that of the top surface, and the side surface forms an acute angle with the base material 200. Also, when the ratio a:b between the width of the top surface and the width of the bottom surface of the first plating layer 300*a* is less than 0.2:1, the second plating may be formed such that the top surface is rounded from a predetermined area of the side surface. Accordingly, the ratio between the top and bottom surfaces of the first plating layer 300*a* is preferred to be adjusted to have the wide width of the top surface and the vertical side surface. Also, a ration between the width b of the bottom surface of the first plating layer 300*a* and the width d of the bottom surface of the second plating layer 300*b* may be 1:1.2 to 1:2, and a ration between the width b of the bottom surface of the first plating layer 300*a* and a distance e between the first plating layers 300*a*, which are adjacent to each other, may be 1.5:1 to 3:1. Here, the second plating layers 300*b* are not in contact with each other. The coil pattern 300 including the first and second plating layers 300*a* and 300*b* may have a ratio between widths of the top and bottom surfaces to be 0.5:1 to 0.9:1, preferably 0.6:1 to 0.8:1. That is, an outer shape of the coil pattern 300, i.e., an outer shape of the second plating layer 300*b*, may have a ratio between the top and bottom surfaces to be 0.5 to 0.9:1. Accordingly, the rounded area of the edge of the top surface of the coil pattern 300 may be less than approximately 0.5 with respect to an ideal rectangular shape having a right angle. For example, the rounded area may be equal to or greater than approximately 0.001 and less than approximately 0.5 in comparison with the ideal rectangular shape having a right angle. Also, the coil pattern 300 in accordance with an exemplary embodiment is not greatly varied in resistance in comparison with the ideal rectangular shape. For example, when the ideally rectangular-shaped coil pattern has a resistance of approximately 100, the coil pattern 300 in accordance with an exemplary embodiment may maintain a resistance of approximately 101 to approximately 110. That is, the coil pattern 300 in accordance with an exemplary embodiment may maintain the resistance that is approximately 101% to approximately 110% of the resistance of the ideally rectangular-shaped coil pattern in accordance with the shape of the first plating layer 300*a* and the shape of the second plating layer 300*b*, which is varied on the basis of the shape of the first plating layer 300*a*. The second plating layer 300*b* may be formed by using the same plating solution as the first plating layer 300*a*. For example, the first and second plating layers 300*a* and 300*b* may use a plating solution based on copper sulfate and sulfuric acid, and, the plating solution may have an improved plating property by adding chlorine (Cl) and an organic compound thereto. The organic compound may improve uniformity, electro-deposition, and gloss characteristics of the plating layer by using a gloss agent and a carrier containing polyethylene glycol (PEG).

In the coil pattern 300, the second plating layer 300*b*, which is provided on the first plating layer 300*a*, may have a lower width A, a central width B, and an upper width C, at least a portion of which is different, in a vertical direction of the second plating layer 300*b*. Here, the central width B may be equal to or greater than the lower width A and equal to or greater than the upper width C. Also, the lower width A may be equal to or greater than the upper width C. For example, the central width B may be greater than each of the lower width A and the upper width C or equal to the lower width A and greater than the upper width C. Alternatively, all of the lower width A, the central width B, and the upper width C may be the same as each other. Here, a lower portion may refer to a height of approximately 10% of the height of the second plating layer 300*b*, a central portion may refer to a height of approximately 10% to approximately 80% of the height of the second plating layer 300*b*, and an upper portion may refer to a height upto the rounded portion.

Also, the coil pattern 300 may be formed by laminating at least two plating layers. Here, each of the plating layers may have a vertical side surface and the same shape and thickness. That is, the coil pattern 300 may be formed on the seed layer through a plating process. For example, the coil pattern 300 may be formed by laminating three plating layers on the seed layer. The above-described coil pattern 300 may be formed through an anisotropic plating process and have an aspect ratio of approximately 2 to approximately 10.

Also, the coil pattern 300 may have a shape having a width that gradually decreases from an innermost circumference to an outermost circumference. That is, n coil pattern 300 having a spiral shape may be formed from the innermost circumference to the outermost circumference. For example, when four patterns are formed, a width of each of the patterns may gradually increase from a first pattern, which is an innermost circumferential pattern, a second pattern, a third pattern, and a fourth pattern, which is an outermost circumferential pattern. For example, when the first pattern has a width of 1, the second pattern may have a ratio of 1 to 1.5, the third pattern may have a ratio of 1.2 to 1.7, and the fourth pattern may have a ratio of 1.3 to 2. That is, the first to fourth patterns may have a ratio of 1:1 to 1.5:1.2 to 1.7:1.3 to 2. In other words, the second pattern may have a width equal to or greater than the first pattern, the third pattern may have a width greater than the first pattern and equal to or greater than the second pattern, and the fourth pattern may have a width greater than each of the first and second patterns and equal to or greater than the third pattern. To gradually increase the width of the coil pattern from the innermost circumference to the outermost circumference, the seed layer may have a width that gradually increases from the innermost circumference to the outermost circumference. Also, at least one area of the coil pattern may have a different width in the vertical direction. That is, the lower, central, and upper portions of at least one area may have a different width.

4. External Electrode

The external electrodes 400 (410, 420) may be disposed on both surfaces, which are opposite to each other, of the body 100. For example, the external electrodes 400 may be disposed on two side surfaces of the body 100, which are opposite to each other in the X-direction. The external electrodes 400 may be electrically connected to the coil patterns 310 and 320 of the body 100. Also, the external electrodes 400 may be formed on the entire two side surfaces of the body 100 and contact the coil patterns 310 and 320 at central portions of the two side surfaces. That is, as the ends of the coil patterns 310 and 320 are exposed to the outside of the body 100, and the external electrodes 400 are provided on the side surfaces of the body 100, the external electrodes 400 may be connected to the coil patterns 310 and 320. The external electrodes 400 may be formed through various methods such as deposition, sputtering, and plating by using a conductive epoxy and a conductive paste. The external electrodes 400 may be provided on only the both side surfaces and bottom surface of the body 100 or provided even on the top surface or the front surface of the body 100. For example, the external electrodes 400 may be provided on the front and rear surfaces in the Y-direction and the top and bottom surfaces in the Z-direction in addition to the both side surfaces in the X-direction. That is, the external electrode 400 may be provided on the both side surfaces in the X-direction, the bottom surface mounted on a printed circuit board, and other areas in accordance with a formation method or a process condition. Also, each of the external electrodes 400 may be formed by mixing, e.g., multi-component glass frit having a main component of $Bi_2O_3$ or $SiO_2$ of approximately 0.5% to approximately 20% with the metal powder. That is, a portion of the external electrode 400, which contacts the body 100, may be made of a conductive material mixed with glass. Here, the mixture of the glass frit and the metal powder may be prepared in a paste type and applied to two surfaces of the main body 100. That is, when a portion of the external electrode 400 is made of a conductive paste, the conductive paste may be mixed with the glass frit. As the glass frit is contained in the external electrode 400, an adhesion force between the external electrodes 400 and the body 100 may be improved, and a contact reaction between the coil pattern 300 and the external electrode 400 may be improved.

The external electrode 400 may be made of electroconductive metal. For example, the external electrode 400 may be made of at least one selected from the group consisting of gold, silver, platinum, copper, nickel, palladium, and an alloy thereof. Here, in an exemplary embodiment, at least a portion of the external electrode 400 connected to the coil pattern 300, i.e., a first layer 411 and 421 provided on the surface of the body 100 and connected to the coil pattern 300 may be made of the same material as the coil pattern 300. For example, the coil pattern 300 is made of copper, at least a portion of the external electrode 400, i.e., the first layer 411 and 421 may be made of copper. Here, as described above, the copper may be provided in a dipping or printing method using a conductive paste or in a method such as deposition, sputtering, and plating. However, in a preferred embodiment, at least the first layer 411 and 421 of the external electrode 400 may be formed in the same method, i.e., plating, as the coil pattern 300. That is, the entire thickness of the external electrode 400 may be formed by copper plating, or a partial thickness of the external electrode 400, i.e., the first layer 411 and 421 connected to the coil pattern 300 to contact the surface of the body 100 may be formed by copper plating. To form the external electrode 400 through the plating process, the external electrode 400 may be formed such that a seed layer is formed on the both side surfaces of the body 100, and then a plating layer is formed from the seed layer. Alternatively, as the coil pattern 300 exposed to the outside of the body 100 serves as a seed, the external electrode 400 may be formed without forming a separate seed layer through plating. Here, an acid treatment process may be performed before the plating process. That is, at least a partial surface of the body 100 may be treated with hydrochloric acid, and then the plating process may be performed. Although the external electrode 400 is formed through plating, the external electrode 400 may be provided on the both side surface, which are opposite to each other, of the body 100 and extend to other side surfaces adjacent thereto, i.e., the top surface and the bottom surface. Here, at least a portion of the external electrodes 400, which is connected to the connection electrode 300, may be the entire side surface of the body 100 or a partial area thereof. Alternately, the external electrode 400 may further include at least one plating layer. That is, the external electrode 400 may include the first layer 411 and 421 connected to the coil pattern 300 and at least one second layer 412 and 422 provided thereon. That is, the second layer 412 and 422 may be one layer or two or more layers. For example, the external electrode 400 may be formed such that at least one of a nickel plating layer (not shown) and a tin plating layer (not shown) is further formed on the copper plating layer. That is, the external electrode 400 may have a laminated structure of a copper layer, a nickel plating layer, and a tin plating layer or a laminated structure of a copper layer, a nickel plating layer, and a tin/silver plating layer. Here, the plating may be performed through electroplating or electroless plating. That is, the first layer 411 and 421 may be formed such that a partial thickness is formed through the electroless plating, and the rest thickness is formed through the electroplating, or the entire thickness is formed through the electroless plating or the electroplating. That is, the second layer 412 and 422 may be formed such that a partial thickness is formed through the electroless plating, and the rest thickness is formed through the electroplating, or the entire thickness is formed through the electroless plating or the electroplating. Alternatively, the first layer 411 and 421 may be formed through the electroless plating or the electroplating, and the second layer 412 and 422 may be formed through the electroless plating or the electroplating in the same manner with the first layer 411 and 421 or may be formed through the electroless plating or the electroplating in a different manner with the first layer 411 and 421. The tin plating layer of the second layer 412 and 422 may have a thickness equal to or greater than the nickel plating layer.

For example, the external electrode 400 may have a thickness of approximately 2 μm to approximately 100 μm, wherein the first layer 411 and 421 400 may have a thickness of approximately 1 μm to approximately 50 μm, and the second layer 412 and 422 400 may have a thickness of approximately 1 μm to approximately 50 μm. Here, in the external electrode 400, the first layer 411 and 421 and the second layer 412 and 422 may have the same thickness or different thicknesses. When the first layer 411 and 421 and the second layer 412 and 422 have different thicknesses, the first layer 411 and 421 may be thicker or thinner than the second layer 412 and 422. In an exemplary embodiment, the first layer 411 and 421 has a thickness less than the second layer 412 and 422. The second layer 412 and 422 may be formed such that the nickel plating layer is formed with a thickness of approximately 1 μm to approximately 10 μm, and the tin or tin/silver plating layer is formed with a thickness of approximately 2 μm to approximately 10 μm.

As described above, as at least a partial thickness of the external electrode 400 is made by using the same material and the same method as the coil pattern 300, a coupling force between the body 100 and the external electrode 400 may be improved. That is, as at least a portion of the external electrode 400 is formed through the copper plating, a coupling force between the coil pattern 300 and the external electrode 400 may be improved. Also, as the external electrode 400 is provided on a partial area of the body 100 in the Y and Z-direction to form a bent portion, and accordingly, a coupling force between the electrode 400 and the body 100 may be improved. The power inductor in accordance with an exemplary embodiment may have a tensile strength of approximately 2.5 $kg_f$ to approximately 4.5 $kg_f$. Accordingly, in accordance with an exemplary embodiment, the tensile strength may further improve than the related art, and thus the body 100 may not be separated from the electronic device mounted with the powder inductor in accordance with an exemplary embodiment. That is, while the external electrode 400 maintains a state of being mounted to the electronic device, the body 100 may not be separated from the external electrode 400.

5. Inner Insulation Layer

An inner insulation layer 510 may be provided between the coil pattern 310 and 320 and the body 100 to insulate the coil pattern 310 and 320 from the metal powder 110. That is, the inner insulation layer 510 may cover the top surface and the side surface of the coil pattern 310 and 320. Also, the inner insulation layer 510 may cover the base material 200 in addition to the top and side surfaces of the coil pattern 310 and 320. That is, the inner insulation layer 510 may be provided on an exposed area further than the coil pattern 310 and 320 of the base material 200 from which a predetermined area is removed, i.e., the surface and the side surface of the base material 200. The inner insulation layer 510 on the base material 200 may have a thickness equal to the inner insulation layer 510 on the coil pattern 310 and 320. The inner insulation layer 510 may be formed by applying parylene on the coil pattern 310 and 320. For example, as the base material 200, on which the coil pattern 310 and 320 is formed, is prepared in a deposition chamber, and then the parylene is vaporized and provided into a vacuum chamber, the parylene may be deposited on the coil pattern 310 and 320. For example, the parylene may be primarily heated in a vaporizer and vaporized into a dimer state and then secondarily heated to be thermally decomposed into a monomer state, and as the parylene is cooled by using a cold trap and a mechanical vacuum pump, which are connected to the deposition chamber, the parylene may be converted from the monomer state into a polymer state and deposited on the coil pattern 310 and 320. Alternatively, the inner insulation layer 510 may be made of an insulating polymer besides the parylene, e.g., at least one selected from the group consisting of epoxy, polyimide, and liquid crystalline polymer. However, as the parylene is applied, the inner insulation layer 510 may be formed on the coli pattern 310 and 320 with a uniform thickness, and although the parylene is formed with a small thickness, the parylene may improve insulation characteristics further than other materials. That is, when the parylene is applied to form the inner insulation layer 510, the inner insulation layer 510 may have a thickness less than that when polyimide is applied to form the inner insulation layer 510 and an insulation breakdown voltage may increase. Thus, the insulation characteristics may be improved. Also, an uniform thickness may be formed by filling a portion between patterns in accordance with a distance between the patterns of the coil pattern 310 and 320 or may be formed along a stepped portion between the patterns. That is, when a distance between the patterns of the coil pattern 310 and 320 is great, the parylene may be applied with an uniform thickness along the stepped portion between the patterns, and when the distance between the patterns is small, a portion between the patterns may be filled to form a predetermined thickness on the coil pattern 310 and 320. FIG. 8 is a photograph showing a cross-section of the power inductor in which the insulation layer is made of polyimide, and FIG. 9 is a photograph showing a cross-section of the power inductor in which the insulation layer is made of parylene. As illustrated in FIG. 9, in case of the parylene, the insulation layer has a small thickness along the stepped portion of the coil pattern 310 and 320. However, in case of the polyimide, the insulation layer has a thickness greater than that in case of the parylene. The inner insulation layer 510 may have a thickness of approximately 3 μm to approximately 100 μm by using the parylene. When the inner insulation layer 510, which is made of the parylene, has a thickness less than approximately 3 μm, the insulation characteristics may be degraded, and when the inner insulation layer 510 has a thickness greater than approximately 100 μm, as the thickness thereof, which occupies in the same size, increases, the volume of the body 100 may decrease, and thus the magnetic permeability may be reduced. Alternatively, the inner insulation layer 510 may be manufactured as a sheet having a predetermined thickness and then formed on the coil pattern 310 and 320.

6. Surface Insulation Layer

A surface insulation layer 520 may be formed on the surface of the body 100. Here, the surface insulation layer 520 may be formed on the rest surface of the body 100 except for the two side surfaces, which are opposite to each other. That is, the coil pattern 300 may be exposed to the two side surfaces, which are opposite to each other, of the body 100, e.g., two side surfaces in the X-direction, and the surface insulation layer 520 may be formed on the rest surface except for the two side surfaces, to which the coil pattern 300 is exposed. In other words, the surface insulation layer 520 may be formed on the rest area except for the two side surfaces of the body 100 while contacting the surface. For example, the surface insulation layer 520 may be formed on two surfaces (i.e., front and rear surfaces), which are opposite to each other in the Y-direction, and two surfaces (i.e., bottom and top surfaces), which are opposite to each other in the Z-direction. The surface insulation layer 520 may be formed to form the external electrode 400 at a desired position through a plating process. That is, since surface resistance is almost the same over the body 100, the plating process may be performed on the entire surface of the body when the plating process is performed. Accordingly, as the surface insulation layer 520 is formed on the area on which the external electrode 400 is not formed, the external electrode 400 may be formed at a desired position. The surface insulation layer 520 may be made of an insulating material, e.g., may be made of one selected from the group consisting of epoxy, polyimide, and liquid crystalline polymer (LCP). Also, the surface insulation layer 520 may be made of thermosetting resin. For example, the thermosetting resin may include at least one selected from the group consisting of a novolac epoxy resin, a phenoxy type epoxy resin, a BPA type epoxy resin, a BPF type epoxy resin, a hydrogenated BPA epoxy resin, a dimer acid modified epoxy resin, an urethane modified epoxy resin, a rubber modified epoxy resin, and a DCPD type epoxy resin. That is, the surface insulation layer 520 may be made of the insulating material 120 of the body 100. The surface insulation layer 520 may be formed by applying or printing a polymer or a thermosetting resin on a predetermined area of the body 100. That is, the surface insulation layer 520 may be formed on four surfaces in the Y-direction and the Z-direction. Alternatively, the surface insulation layer 520 may be formed on the entire surface of the body 100, and then the surface insulation layer 520 on two side surfaces, which are opposite to each other in the X-direction of the body 100, may be removed to allow the surface insulation layer 520 on the four surfaces in the Y-direction and the Z-direction to be remained. Also, the surface insulation layer 520 may be made of parylene or various insulating materials such as a silicon oxide layer ($SiO_2$), a silicon nitride layer (Si3N4), and a silicon oxynitride layer (SiON). When the surface insulation layer 520 is formed of the above-described materials, the surface insulation layer 520 may be formed through various methods such as CVD or PVD. The surface insulation layer 520 may have a thickness equal to or different from that of the external electrode 400, e.g., a thickness of approximately 3 um to approximately 30 um.

7. Coupling Layer

A coupling layer 600 may be formed between the body 100 and an extended portion of the external electrode 400. That is, the external electrode 400 may extend in the Y-direction and the Z-direction except for the two side surfaces of the body 100 in the X-direction, and the coupling layer 600 may be formed between the body 100 and the extended portion of the external electrode 400. The coupling layer 600 may be formed so that the external electrode 400 is firmly formed on the four surfaces in the Y-direction and the Z-direction through a plating process. That is, since the surface insulation layer 520 is formed on an area on which the external electrode 400 extends, i.e., a bent portion, the area has a resistance greater than that of the side surface of the body 100, and thus plating growth is not properly performed on the area. Accordingly, an area of the external electrode 400, which is formed on the surface insulation layer 520, may have a coupling force less than an area of the external electrode 400, which contacts the body 100. Thus, the coupling layer 600 is formed to increase a coupling force and a tensile strength so that the plating growth is properly performed even on the surface insulation layer 520. As the coupling layer 600 is formed on the surface insulation layer 520 of the bent portion and then the extended area of the external electrode 400 is formed, the coupling force of the external electrode 400 may be improved further than when the extended area of the external electrode 400 is formed on the surface insulation layer 520. The coupling layer 600 is formed on the surface insulation layer 520 and then remained only on the bent portion by a polishing process for exposing the coil pattern 300. That is, the surface insulation layer 520 is formed on the entire top surface of the body 100, the coupling layer 600 is formed on the entire two side surfaces and a portion of the front, rear, top, and bottom surfaces of the body 100, and then the two side surfaces of the body 100 is polished to expose the coil pattern 300. As a result, the coupling layer 600 is remained on the bent portion. The coupling layer 600 may be formed through various methods such as CVD, PVD, and plating. Also, the coupling layer 600 may be formed of metal such as gold (Au), lead (Pd), copper (Cu), and nickel (Ni) or an alloy of two or more thereof.

The coupling layer 600 may be formed through copper plating. Thus, the coil pattern 300, at least a portion of the external electrode 400, and the coupling layer 600 may be formed of the same material and through the same process. The coupling layer 600 may have a thickness less than that of each of the surface insulation layer 520 and the external electrode 400. For example, the coupling layer 600 may have a thickness less than that of the first layer 411 and 421 of the external electrode 400.

8. Capping Insulation Layer

As illustrated in FIG. 10, a capping insulation layer 530 may be formed on the top surface of the body 100 provided with the external electrode 400. That is, the capping insulation layer 530 may be formed on the top surface of the body 100, which is opposite to the bottom surface of the body 100 mounted on a printed circuit board (PCB), e.g., a top side surface in the Z-direction. The capping insulation layer 530 may be formed to prevent a short-circuit between the external electrode 400 extending from the top surface of the body 100 and a shield can or between the power inductor and a circuit component thereabove. That is, the power inductor is mounted on the printed circuit board while the external electrode 400 formed on the bottom surface of the body 100 is disposed adjacent to a power management IC (PMIC), wherein the PMIC has a thickness of approximately 1 mm, and the power inductor also has the same thickness. The PMIC may generate high-frequency noises to affect surrounding circuits or elements. Thus, the PMIC and the power inductor may be covered by the shield can that is made of a metal material, e.g., a stainless steel material. However, the power inductor may be short-circuited with the shield can because the external electrode is also disposed thereabove. Thus, as the capping insulation layer 530 is formed on the top surface of the body 100, a short-circuit between the power inductor and an external conductive material may be prevented. The capping insulation layer 530 may be made of an insulating material, e.g., at least one selected from the group consisting of epoxy, polyimide, and liquid crystalline polymer (LCP). Also, the capping insulation layer 530 may be made of thermosetting resin. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, an urethane modified epoxy resin), a rubber modified epoxy resin, and a DCPD type epoxy resin. That is, the capping insulation layer 530 may be made of the insulating material 120 of the body 100 or a material forming the surface insulating layer 520. The capping insulation layer 530 may be formed by dipping the top surface of the body 100 into polymer, thermosetting resin, or the like. Accordingly, the capping insulation layer 530 may be formed on a portion of the both side surfaces of the body 100 in the X-direction and a portion of the front and rear surfaces of the body 100 in the Y-direction in addition to the top surface of the body 100. Also, the capping insulation layer 530 may be made of parylene or various insulating materials such as a silicon oxide layer ($SiO_2$), a silicon nitride layer ($Si_3N_4$), and a silicon oxynitride layer (SiON). When the capping insulation layer 530 is formed of the above-described materials, the surface insulation layer 520 may be formed through various methods such as CVD or PVD. When the capping insulation layer 530 is formed through CVD or PVD, the capping insulation layer 530 may be formed on only the top surface of the body 100. The capping insulation layer 530 may have a thickness for preventing a short-circuit between the external electrode 400 of the power inductor 100 and the shield can, e.g., a thickness of approximately 10 μm to approximately 100 μm. Here, the capping insulation layer 530 may have a thickness equal to or different from that of the external electrode 400 and equal to or different from that of the surface insulation layer 520. For example, the capping insulation layer 530 may have a thickness greater than that of each of the external electrode 400 and the surface insulation layer 520. Alternatively, the capping insulation layer 530 may have a thickness equal to that of each of the external electrode 400 and the surface insulation layer 520. Also, the capping insulation layer 530 may be formed on the top surface of the body with a uniform thickness to maintain the stepped portion between the external electrode 400 and the body 100 or have a thickness on the top surface of the body 100, which is greater than that on the top surface of the external electrode 400, to remove the stepped portion between the external electrode 400 and the body 100 so that the surface is flattened. Alternatively, the capping insulation layer 530 may be separately formed with a predetermined thickness and then bonded on the body 100 by using adhesive or the like.

As described above, the power inductor in accordance with an exemplary embodiment may improve the coupling force between the body 100 and the external electrode 400 by forming at least a partial thickness of the external electrode 400 with the same material 300 and the same method as the coil pattern. That is, as the coil pattern 300 and the external electrode 400 are formed through copper plating, the coupling force between the coil pattern 300 and the external electrode 400 may be improved. Accordingly, the tensile strength may further improve, and thus the body may not be separated from the electronic device mounted with the powder inductor in accordance with an exemplary embodiment. Also, the coupling layer 600 may be formed between the surface insulation layer 520 and the external electrode 400 extending from the side surface of the body 100, i.e., the external electrode 400 on the bent portion. As the coupling layer 600 is formed, since the plating growth on the extended area of the external electrode 400 is properly performed, the coupling force may be improved, and thus the tensile strength also may be improved. As the capping insulation layer 550 is formed to prevent the external electrode 400 on the top surface of the body 100 from being exposed, the external electrode 400 may be prevented from contacting the shield can, and thus the short-circuit therebetween may be prevented. Also, as the body 100 includes the thermal conductive filler 130 in addition to the metal powder 110 and the insulating material 120, the heat of the body 100 due to the heating of the metal powder 110 may be discharged to the outside to prevent the body 100 from increasing in temperature, and thus a limitation such as reduction in inductance may be prevented. Also, as the inner insulation layer 510 is formed between the coil pattern 310 and 320 and the body 100 by using parylene, the inner insulation layer 510 may be formed on the side and top surfaces of the coil pattern 310 and 320 with a small and uniform thickness and have the improved insulation characteristics.

Manufacturing Method

FIGS. 11 to 17 are cross-sectional views for sequentially explaining a method of manufacturing a power inductor in accordance with an exemplary embodiment.

Figure 11:
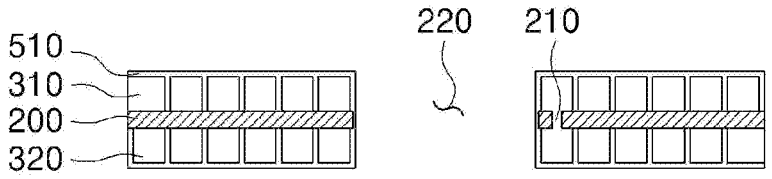
FIGS. 11 to 17 are cross-sectional views for sequentially explaining a method of manufacturing the power inductor in accordance with an exemplary embodiment.

Referring to FIG. 11, the coil pattern 310 and 320 having a predetermined shape are formed on at least one surface of the base material 200, preferably, one surface and the other surface of the base material 200. The base material 200 may be manufactured by using a CCL or a metal magnetic material, preferably, a metal magnetic material that is capable of increasing effective magnetic permeability and easily realizing a capacity. For example, the base material 200 may be manufactured by bonding a copper foil to one surface and the other surface of a metal plate that is made of a metal alloy containing iron and has a predetermined thickness. Here, for example, the through-hole 220 is formed in a central portion of the base material 200, and the conductive via 210 is formed in a predetermined area of the base material 200. Also, the base material 200 may have a shape in which an outer area is removed in addition to the through-hole 220. For example, the through-hole 220 is formed in the central portion of the base material 200 having a rectangular plate shape with a predetermined thickness, the conductive via 210 is formed in a predetermined area of the base material 200, and at least a portion of the outer side of the base material is removed. Here, the removed portion of the base material 200 may be an outer portion of the coil pattern 310 and 320 having a spiral shape. Also, the coil pattern 310 and 320 may be formed on a predetermined area of the base material 200, e.g., in a circular spiral shape from the central portion. Here, the coil pattern 310 may be formed on one surface of the base material 200 and then a conductive via passing through a predetermined area of the base material 200 and filled with a conductive material may be formed, and the coil pattern 320 may be formed on the other surface of the base material 200. The conductive via 210 may be formed such that the via hole is formed in a thickness direction of the base material 200 by using laser or the like, and then a conductive paste is filled into the via hole. Also, the coil pattern 310 may be formed through, for example, a plating process. To this end, a photosensitive pattern having a predetermined shape may be formed on one surface of the base material 200, and the plating process using the copper foil on the base material 200 as a seed may be performed to grow a coupling layer from a surface of the exposed base material 200. Then, the photosensitive film may be removed to form the coil pattern 310. Also, the coil pattern 320 may be formed on the other surface of the base material 200 through the same method as the coil pattern 310. The coil pattern 310 and 320 may be formed with a multilayer structure. When the coil pattern 310 and 320 is formed with the multilayer structure, an insulation layer may be formed between a lower layer and an upper layer. Then, a second conductive via (not shown) may be formed in the insulation layer to connect the multilayered coil patterns to each other. As described above, the coil pattern 310 and 320 may be formed on the one surface and the other surface of the base material 20, and then, the inner insulation layer 510 may be formed to cover the coil pattern 310 and 320. The inner insulation layer 500 may be formed by applying an insulating polymer material such as parylene. Preferably, the inner insulation layer 510 may be formed on the top and side surfaces of the base material 200 in addition to the top and side surfaces of the coil pattern 310 and 320 by applying the parylene. Here, the inner insulation layer 510 may be formed with the same thickness on the top and side surfaces of the coil pattern 310 and 320 and the top and side surfaces of the base material 200. That is, as the base material 200 on which the coil pattern 310 and 320 is formed is prepared in a deposition chamber, and then the parylene is vaporized and provided into a vacuum chamber, the parylene may be deposited on the coil pattern 310 and 320 and the base material 200. For example, the parylene may be primarily heated in a vaporizer and vaporized into a dimer state and then secondarily heated to be thermally decomposed into a monomer state, and as the parylene is cooled by using a cold trap and a mechanical vacuum pump, which are connected to the deposition chamber, the parylene may be converted from the monomer state into a polymer state and deposited on the coil pattern 310 and 320. Here, the primary heating process for vaporizing the parylene into the dimer state is performed at a temperature of approximately 100° C. to approximately 200° C. and a pressure of approximately 1.0 Torr, and the secondary heating process for thermally decomposing the vaporized parylene into the monomer state is performed at a temperature of approximately 400° C. to approximately 500° C. and a pressure of approximately 0.5 Torr or more. Also, the deposition chamber may maintain a room temperature of approximately 25° C. and a pressure of approximately 0.1 Torr in order to deposit the parylene while converting the monomer state into a polymer state. As the parylene is applied on the coil pattern 310 and 320, the inner insulation layer 510 may be applied along the stepped portion between the coil pattern 310 and 320 and the base material 200, and accordingly, the inner insulation layer 510 may have a uniform thickness. Alternatively, the inner insulation layer 510 may be formed by closely attaching a sheet including at least one selected from the group consisting of epoxy, polyimide, and liquid crystal crystalline polymer to the coil pattern 310 and 320.

Figure 12:
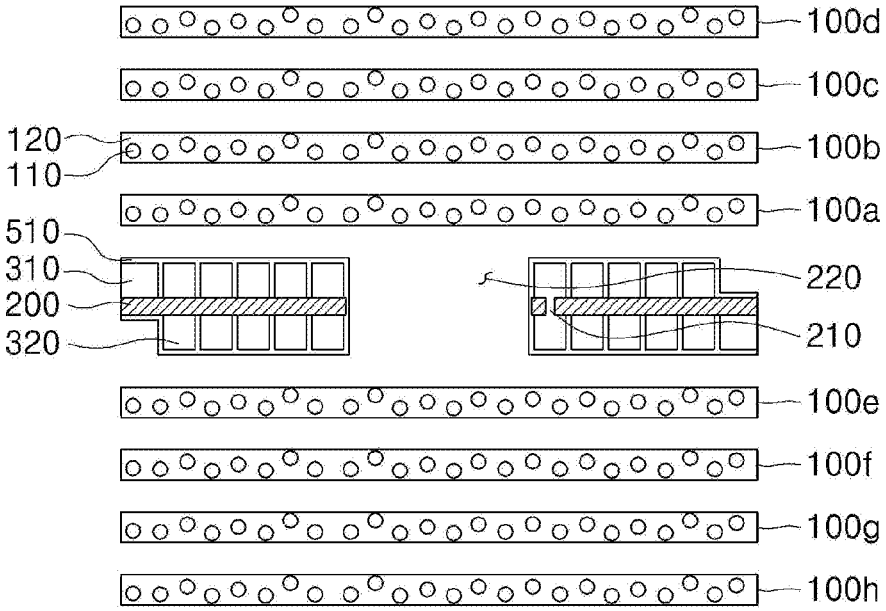

Referring to FIG. 12, a plurality of sheets 100*a* to 100*h* made of a material including the metal powder 110, the polymer 120, and the thermal conductive filler 130 are prepared. Here, the metal powder 110 may use a metal material containing iron (Fe), and the insulating material 120 may use epoxy and polyimide, which are capable of insulating the metal powder 110 from each other. The thermal conductive filler may use MgO, AlN, and carbon-based materials, which are capable of discharging the heat of the metal powder 110 to the outside. Also, the surface of the metal powder 110 may be coated with a magnetic material, e.g., a metal oxide magnetic material or an insulating material such as parylene. Here, the insulating material 120 may be contained at a content of 2.0 wt % to 5.0 wt % on the basis of 100 wt % of the metal powder 110, and the thermal conductive filler 130 may be contained at a content of 0.5 wt % to 3 wt % with respect to 100 wt % of the metal powder 110. The plurality of sheets 100*a* to 100*h* are disposed above and below the base material 200 on which the coil pattern 310 and 320 is formed, respectively. The plurality of sheets 100*a* to 100*h* may be different in content of the thermal conductive filler. For example, the content of the thermal conductive filler may gradually increase upward and downward from the one surface and the other surface of the base material 200. That is, the thermal conductive filler of each of the sheets 100*b* and 100*e*, which are disposed above and below the sheets 100*a* and 100*d* contacting the base material 200, may have a content greater than that of the thermal conductive filler of each of the sheets 100*a* and 100*d*, and the thermal conductive filler of each of the sheets 100*c* and 100*f*, which are disposed above and below the sheets 100*b* and 100*e*, may have a content greater than that of the thermal conductive filler of each of the sheets 100*b* and 100*e*. Since the content of the thermal conductive filler gradually increases in a direction that is away from the base material 200, thermal transfer efficiency may be more enhanced. First and second magnetic layers (not shown) may be provided above and below the uppermost and bottommost sheets 100*a* and 100*h*, respectively. The first and second magnetic layers may be made of a material having magnetic permeability higher than that of the sheets 100*a* to 100*h*. For example, the first and second magnetic layers may be made of magnetic powder and an epoxy resin so as to have magnetic permeability higher than that of the sheets 100*a* to 100*h*. Also, the first and second magnetic layers may further include the thermal conductive filler.

Figure 13:
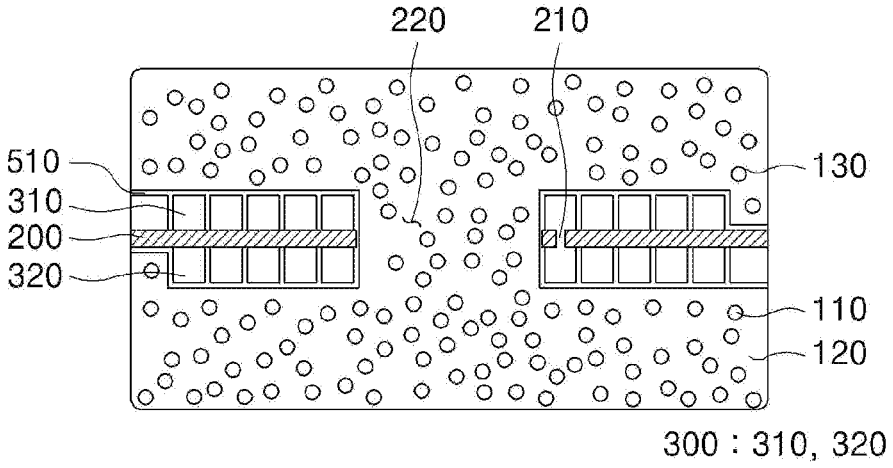

Referring to FIG. 13, the body 100 is formed such that a plurality of sheets 100*a* to 100*h*, which are disposed with the base material 200 therebetween, may be laminated and compressed and then molded. Accordingly, the through-hole 220 and removed portion of the base material 200 may be filled with the body 100. Also, the body 100 and the base material 200 are cut into unit elements. The body 100, which is cut into the unit elements, may be molded or cured.

Figure 14:
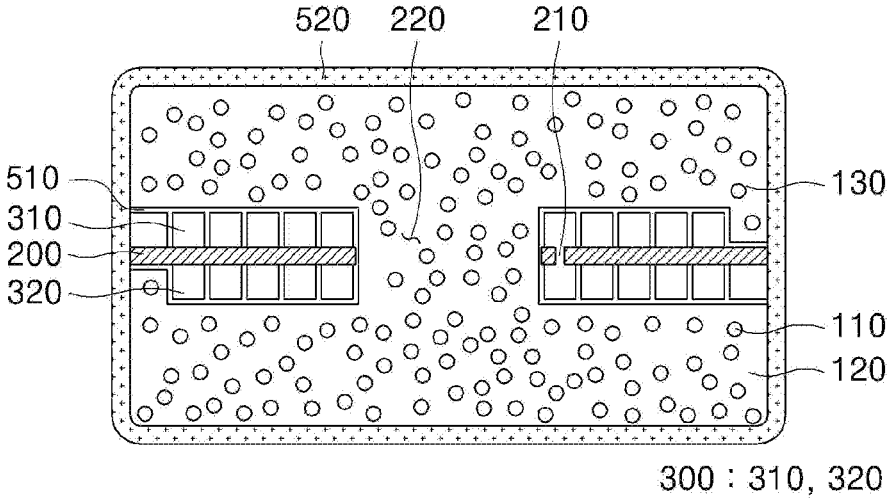

Referring to FIG. 14, the surface insulation layer 520 is formed on the surface of the body 100. The surface insulation layer 520 may be formed through various methods including printing, dipping, and spraying. Also, the surface insulation layer 520 may be formed by using an insulating material such as silicon, epoxy, organic coating solutions, and glass frit and may have a thickness of approximately 5 μm to approximately 40 μm. Here, the edge of the body may be polished before the surface insulation layer 520 is formed. That is, the edge may be chamfered through a polishing process to prevent the body 100 form being broken. Here, the edge of the body 100 may be formed to be inclined or rounded so as to have a predetermined angle instead of a right angle. As the edge of the body 100 is inclined, the external electrode 400 may be formed with a uniform thickness. That is, when the edge of the body 100 has a right angle, the external electrode 400 may be formed on the edge with a thickness less than that of the surface, and thus a limitation, in which the external electrode 400 is cut or a resistance increases, may occur. Thus, as the edge is formed to be inclined, such a limitation may be prevented.

Figure 15:
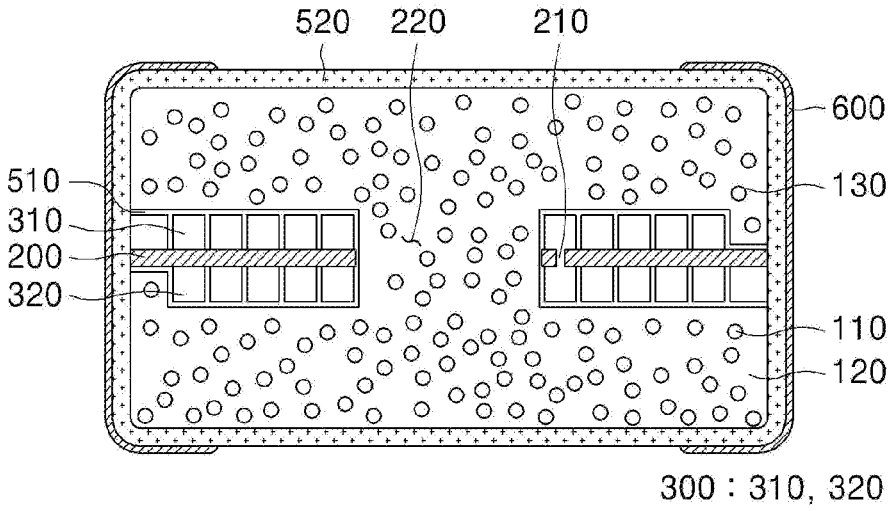

Referring to FIG. 15, the coupling layer 600 is formed on a predetermined area on the body 100 on which the surface insulation layer 520 is formed. The coupling layer 600 may be formed on an area on which the external electrode 400 will be formed. For example, when the external electrode 400 is formed on two side surfaces of the body 100, which are opposite to each other in the X-direction, the coupling layer 600 may be formed on the two side surfaces of the body 100 in the X-direction and surfaces, which are adjacent thereto, in the Y-direction and the Z-direction. The coupling layer 600 may be formed through various methods such as PVD, CVD, plating, dipping, and spraying. Also, the coupling layer 600 may be made of metal including gold (Au), lead (Pd), copper (Cu), and nickel (Ni) and an alloy of two or more thereof. That is, the coupling layer 600 may be made of metal or a metal alloy with one layer or two or more layers. For example, the coupling layer 600 may be formed by at least one of a gold layer and a lead layer through PVD or CVD. For another example, the coupling layer 600 may be formed by using a solution in which at least one of nickel and copper is melted or a solution in which one of gold and lead is melted through plating, dipping, or spraying. As a gloss agent and a carrier containing polyethylene glycol (PEG) are used for the solution in which metal particles are melted, uniformity, electro-deposition, and gloss characteristics may be enhanced. The coupling layer 600 may be formed by using the same material and the same method as the external electrode 400. That is, as the coupling layer 600 and the external electrode 400 are formed by using the same material and the same method as each other, the coupling layer 600 and the external electrode 400 may have the same property, and thus the coupling force between the coupling layer 600 and the external electrode 400 may be improved. For example, the coupling layer 600 may be formed through a copper plating process. Alternatively, in order to form the coupling layer 600 only on a partial area in the Y-direction and the Z-direction, the coupling layer 600 may be formed, and then an etching process for removing a partial area thereof may be preformed, or a predetermined mask may be formed, and then the coupling layer 600 may be formed and the mask may be removed.

Figure 16:
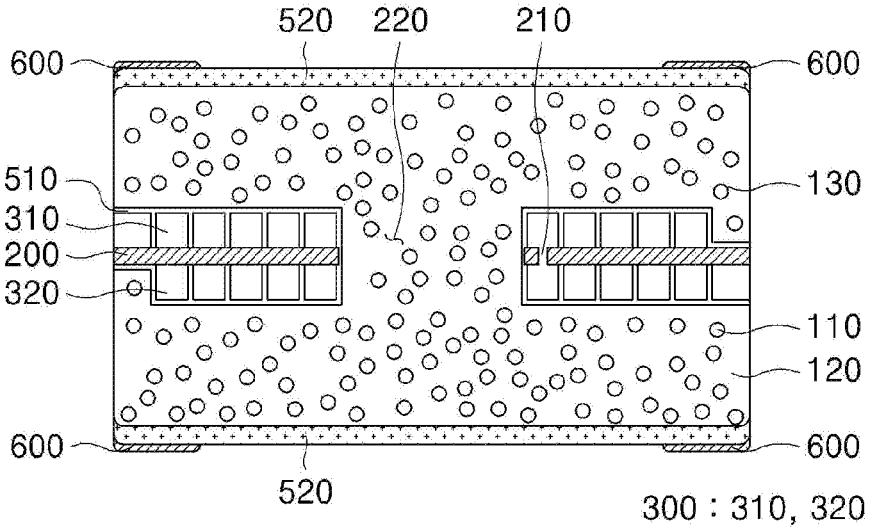

Referring to FIG. 16, the coupling layer 600 and the surface insulation layer 520 disposed on a partial surface of the body are removed. That is, the coupling layer 600 and the surface insulation layer 520 on an area on which the external electrode 400 will be formed are removed so that the external electrode is connected to the coil pattern 300. For example, the coupling layer 600 and the surface insulation layer 520 on the two side surfaces of the body 100, which are opposite to each other in the X-direction, are removed Here, the coupling layer 600 and the surface insulation layer 520 are removed to expose the coil pattern 300 to the side surface of the body 100. For example, a polishing process may be used to expose the coil pattern 300. Thus, the coupling layer 600 may be remained on a partial area of the four surfaces of the body 100 in the Y-direction and the Z-direction.

Figure 17:
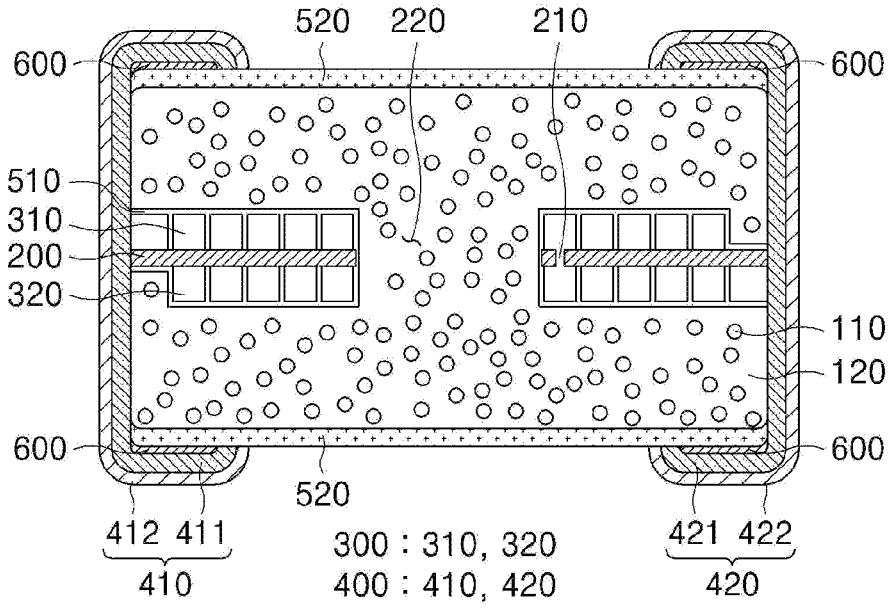

Referring to FIG. 17, the external electrode 400 may be formed on both ends of the body 100 of the unit element so that the external electrode 400 is electrically connected to a withdrawn portion of the coil pattern 310 and 320. The external electrode 400 may extend from the two side surface of the body, to which the coil pattern 300 is exposed, to the surface, which is adjacent thereto, of the body 100. That is, the external electrode 400 may be formed on the two side surfaces of the body 100 and the coupling layer 600, which is adjacent thereto, of the body 100. Here, at least a portion of the external electrode 400 may be formed by using the same material and the same method as the coil pattern 300. That is, the first layer 411 and 421 may be formed through various methods such as electroless plating and electroplating, and the second layer 412 and 422 may be formed by at least one layer through a plating process using nickel, tin, or the like. Here, the external electrode 400 may use the coil pattern 300, which is exposed to the outside of the body 100, as a seed. As the coupling layer 600 is formed on the body 100 and the extended area of the external electrode 400, i.e., the bent portion, the external electrode 400 may be properly formed on the bent portion, and thus the coupling force of the bent portion may be improved. The first layer 411 and 421 may have a thickness of approximately 5 μm to approximately 40 μm, and the second layer 412 and 422 may have a thickness of approximately 1 μm to approximately 20 μm. Also, when the second layer 412 and 422 has two layers, e.g., a nickel plating layer and a tin plating layer, the nickel plating layer may have a thickness of approximately 1 μm to approximately 10 μm, and the tin plating layer may have a thickness of approximately 1 μm to approximately 10 μm. That is, the nickel plating layer may have the same thickness as the tin plating layer. Here, the plating solution for forming the first layer 411 and 421 may use a plating solution in which approximately 5% of sulfuric acid ($H_2SO_4$) and approximately 20% of copper sulfate ($CuSO_4$) are mixed or a plating in which approximately 25% of acid medicine and approximately 3.5% of copper are mixed. As at least a portion of the external electrode 400 is formed through copper plating, the coupling force of the external electrode 400 may become stronger. Here, the coupling force between the coil pattern 300 and the external electrode 400 may be greater than that between the body 100 and the external electrode 400. The capping insulation layer may be formed not to expose the external electrode 400 extending to the top surface of the body 100.

Experimental Example

In accordance with an exemplary embodiment, as at least a portion of the external electrode 400 is formed by the same method, i.e., copper plating, as the coil pattern 300, the coupling force between the external electrode 400, the coil pattern 300, and the body 100 may be improved. Also, as the coupling layer 600 is formed on the extended area of the external electrode 400, i.e., below the external electrode 400 of the bent portion, the coupling force between the external electrode 400 and the body 100 may be improved. The exemplary embodiment, in which the coupling layer 600 is formed on the bent portion, and the external electrode is formed through copper plating, and a related-art example, in which the external electrode is formed by applying epoxy, are compared in tensile strength.

First, the external electrode is formed to measure a tensile strength, and then a wire is soldered on the external electrode. The tensile strength is measured by pulling the soldered wire. That is, the tensile strength is measured when the body 100 is torn or the external electrode 400 is separated from the body 100 by pulling the wire. Here, the external electrode is formed by applying epoxy in the related-art example, and the external electrode is formed through plating in the exemplary embodiment. Here, the coupling layer is not formed in the related-art example, and the coupling layer is formed in the exemplary embodiment. That is, while the external electrode is formed by applying conductive epoxy in a state in which the surface insulation layer is formed in the related-art example, the coupling layer is formed on a partial area on the surface insulation layer, and then the external electrode is formed through a plating process. Besides, shapes of the body, the base material, and the coil pattern are the same as each other in the related-art example and the exemplary embodiment. Also, a plurality of power inductors in accordance with the related-art example and the exemplary embodiment are manufactured, and then the tensile strength of each of the plurality of power inductors are measured. Thereafter, an average of the measured tensile strengths is calculated.

Figure 18:
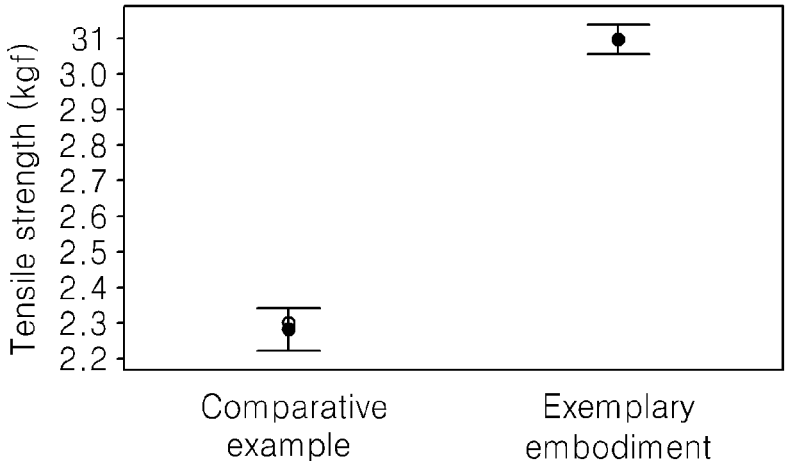
FIG. 18 is a graph showing a tensile strength of a power inductor in accordance with a related-art example and an exemplary embodiment.

FIG. 18 is a graph showing a state in which tensile strength in accordance with the related-art example and the exemplary embodiment are compared. Here, the tensile strength represents a force when the external electrode is separated from the body by increasing a force of pulling the wire. As illustrated in FIG. 18, in the related-art example, a tensile strength of approximately 2.2 $kg_f$ to approximately 2.35 $kg_f$ is measured, and an average of approximately 2.28 $kg_f$ is calculated. However, in the exemplary embodiment, a tensile strength of approximately 3.0 $kg_f$ to approximately 3.1 $kg_f$ is measured, and an average of approximately 3.05 $kg_f$ is calculated For reference, a range indicated in the drawing refers to a measuring range, and a dot therebetween refers to an average. Accordingly, a tensile strength of the exemplary embodiment is greater by approximately 30% to approximately 40% than that of a comparative example. Accordingly, in the exemplary embodiments, the coupling force between the external electrode and the body or the coil pattern may be improved, and thus a limitation, in which the body is separated when mounted to an electronic device, is not generated.

Figure 19:
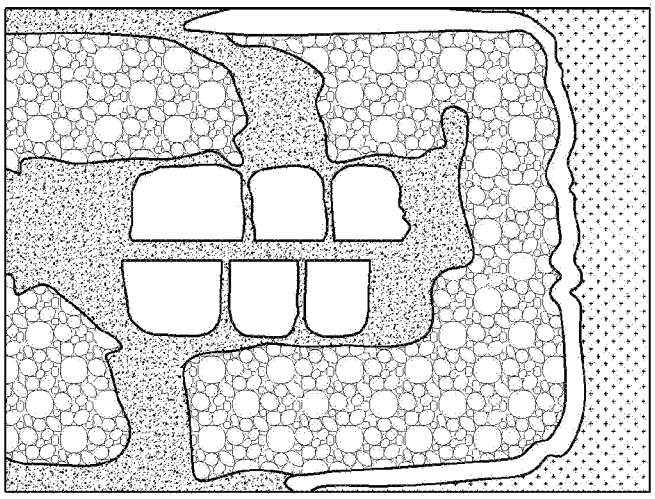
FIG. 19 is a photograph showing a cross-section of the power inductor after a tensile strength experiment in accordance with an exemplary embodiment.

In the exemplary embodiment, when the tensile force is continuously applied, the body may be broken. That is, as illustrated in FIG. 19, when the tensile force is continuously applied, the body may be broken. That is, the external electrode is separated from the body in accordance with the tensile strength in the related art. However, in the exemplary embodiment, the body may be broken when the tensile force is continuously applied because the coupling force between the coil pattern and the external electrode is greater than that between the body and the external electrode. That is, in the exemplary embodiment, since the coupling force between the coil pattern and the external electrode is extremely strong, the body and the external electrode may not be separated from each other although the body is broken. Also, the body and the external electrode is strongly coupled on the bent portion by the coupling part, the external electrode of the bent part is not separated.

Other Embodiments

Hereinafter, other exemplary embodiments will be described. In another exemplary embodiment, a detailed description overlapping that in an exemplary embodiment will be omitted. Unless additionally described, a detailed configuration of another exemplary embodiment is the same as that of an exemplary embodiment. For example, in other exemplary embodiments, the external electrode 400 includes a first layer formed through copper plating and a second layer formed through nickel or tin plating. Also, the surface insulation layer 520 is formed on four surfaces except for two side surfaces of the body 100, on which the external electrode 400 is formed in a contact manner, and the coupling layer 600 is formed between the extended area of the external electrode 400 and the surface insulation layer 520.

In accordance with another exemplary embodiment, the power inductor may further include at least one magnetic layer (not shown) provided in the body 100. The magnetic layer may be provided on at least one of a top surface and a bottom surface. Also, at least one magnetic layer may be provided between the base material 200 and the top surface or bottom surface of the body in the body 100. Here, the magnetic layer may be provided to increase the magnetic permeability of the body 100 and made of a material having the magnetic permeability greater than the body 100. For example, the body 100 may have magnetic permeability of approximately 20, and the magnetic layer may have magnetic permeability of approximately 40 to approximately 1000. The magnetic layer may be manufactured by using, e.g., magnetic powder and an insulating material. That is, the magnetic layer may be made of a material having a magnetic property greater than the magnetic material of the body 100 so as to have high magnetic permeability or may have the further greater content of the magnetic material. For example, in the magnetic layer, the insulating material may be added at approximately 1 wt % to approximately 2 wt % on the basis of approximately 100 wt % of metal powder. That is, the magnetic layer may include the metal power that is greater in amount than that of the body 100. The magnetic layer may further include a thermal conductive filler (not shown) in addition to the metal powder and the insulating material. The thermal conductive filler may be contained in a content of approximately 0.5 wt % to approximately 3 wt %, based on approximately 100 wt % of the metal powder. Materials used as the metal powder and the thermal conductive filler of the magnetic layer may be selected from the materials suggested in the description of an exemplary embodiment. The magnetic layer may be manufactured in a sheet-type and provided on each of upper and lower portions of the body in which a plurality of sheets are laminated. Also, the body 100 may be formed by printing a paste, in a predetermined thickness, made of a material including the metal powder 110 and the polymer 120 or further including the thermal conductive filler 130, or filling the paste into a frame and compressing the paste, and then the magnetic layer 710 and 720 may be formed on each of the upper and lower portions of the body 100. Alternatively, the magnetic layer may be formed by using the paste, i.e., formed by applying the magnetic material to the upper and lower portions of the body 100.

As described above, the power inductor in accordance with another exemplary embodiment may include at least one magnetic layer in the body 100 to enhance the magnetism rate of the power inductor.

In accordance with yet another exemplary, at least two base materials 200 disposed in the body 100 may be provided, and the coil pattern 300 may be formed on one surface of each of the at least two base materials 200. Also, the external electrode 400 is formed outside the body 100 so that the external electrode 400 is connected to the coil pattern 300 formed on each of the different base materials 200, and a connecting electrode (not shown) may be formed outside the body so as to connect the coil pattern 300 formed on each of the different base materials 200 For example, a first external electrode may be formed to be connected to a first coil pattern formed on a first base material, a second external electrode may be formed to be connected to a third coil pattern formed on a second base material, and a connecting electrode may be formed to be connected to second and fourth coil patterns, which are formed on the first and second base materials, respectively. Here, the connecting electrode may be formed on, e.g., at least one surface of the body 100, on which the external electrode 400 is not formed, in the Y-direction. Also, the connecting electrode may be formed by using the same material and the same process as the external electrode 400.

As described above, the power inductor in accordance with yet another exemplary embodiment may increase a capacity thereof such that at least two base materials 200, each of which has at least one surface on which the coil pattern 300 is formed, are spaced apart from each other in the body 100, and, as the coil pattern 300 formed on each of the different base material 200 is connected by a connecting electrode outside the body 100, a plurality of coil patterns are formed. That is, the coil patterns 300 formed on the different base materials 200, respectively, by using the connecting electrode outside the body 100 may be serially-connected to each other, and thus the capacity of the power inductor in the same area may increase.

In accordance with still another exemplary embodiment, the power inductor may include: at least two base materials 200 vertically provided in the body 100; the coil pattern 300 formed on at least one surface of each of the at least two base materials 200; and external electrodes 400 provided outside the body 100 and connected to the coil patterns 300 formed on the at least two base materials 200, respectively. For example, the plurality of base materials 200 may be spaced apart from each other in a longitudinal direction that is perpendicular to a thickness direction of the body 100. That is, while the plurality of base materials 200 are arranged in the thickness direction of the body 100, e.g., the vertical direction in accordance with yet another exemplary embodiment, the plurality of base materials 200 are arranged in a direction perpendicular to the thickness direction of the body 100, e.g., the horizontal direction in accordance with still another exemplary embodiment. Also, the external electrode 400 may be connected to each of the coil patterns 300 formed on the plurality of base materials 200, respectively. For example, each of first and second external electrodes, which are opposite to each other, is connected to the coil pattern formed on a first base material, each of third and fourth external electrodes, which are spaced apart from the first and second external electrodes, is connected to the coil pattern formed on a second base material, and each of fifth and sixth external electrodes, which are spaced apart from the third and fourth external electrodes, is connected to the coil pattern formed on a third base material. That is, the external electrodes 400 are connected to the coil patterns 300 formed on the plurality of base materials 200, respectively.

As described above, the power inductor in accordance with still another exemplary embodiment may realize a plurality of inductors in one body 100. That is, as at least two base materials 200 are arranged in a horizontal direction, and the coil patterns 300 formed thereon, respectively, are connected to the external electrodes 400, which are different from each other, the plurality of inductors are arranged in parallel to each other, and thus at least two power inductors are realized in one body 100.

In accordance with yet still another exemplary embodiment, at least two base materials 200 are laminated while being spaced a predetermined distance in the thickness direction of the body 100, e.g., the vertical direction, and the coil patterns 300 formed on the base materials 200 are withdrawn in directions, which are different from each other, and connected to the external electrodes 400, respectively. That is, while the plurality of base materials 200 are arranged in the horizontal direction in accordance with still another exemplary embodiment, the plurality of base materials 200 are arranged in the vertical direction in accordance with yet still another exemplary embodiment. Accordingly, in accordance with yet still another exemplary embodiment, as at least two base materials 200 are arranged in the thickness direction of the body 100, and the coil patterns 300 formed on the base materials 200, respectively, are connected by the external electrodes 400, which are different from each other, the plurality of inductors are provided in parallel to each other, and thus at least two power inductors are realized in one body 100.

As described above, in accordance with yet another to yet still another exemplary embodiments, the plurality of base materials 200, each of which has at least one surface on which the coil pattern 300 is formed, are laminated in the thickness direction (i.e., vertical direction) of the body 100 or arranged in a direction perpendicular thereto (i.e., horizontal direction). Also, the coil patterns 300 formed on the plurality of base materials 200, respectively, may be connected in serial or parallel to the external electrodes 400. That is, the coil patterns 300 formed on the plurality of base materials 200, respectively, may be connected in parallel to the external electrodes 400, which are different from each other, and the coil patterns 300 formed on the plurality of base materials 200, respectively, may be connected in serial to the same external electrode 400. In case of the serial connection, the coil patterns 300 formed on the base materials 200, respectively, may be connected to the external electrode by the connecting electrode outside the body 100. Accordingly, in case of the parallel connection, two external electrodes 400 are required for each of the plurality of base materials 200, and in case of the serial connection, two external electrodes 400 are required, and at least one connecting electrode is required regardless of the number of the base materials 200. For example, when the coil patterns 300 formed on at least three base materials 300 are connected in parallel to the external electrodes 400, six external electrodes 400 are required, and when the coil patterns 300 formed on at least three base materials 300 are connected in serial to the external electrodes 400, two external electrodes 400 and at least one connecting electrode are required. Also, a plurality of coils are provided in the body 100 in case of the parallel connection, and one coil is provided in the body 100 in case of the serial connection.

In accordance with the exemplary embodiments, the power inductor including at least one base material 200 on which the coil pattern 300 is formed and which is disposed in the body 100 is described as an example. However, the exemplary embodiments may be applied to all of chip components that forms the external electrode on the surface of the body. For example, the exemplary embodiments may be applied to a component forming an external electrode, such as a chip component in which an inductor as well as a capacitor are formed and a chip component in which a ESD protection unit such as a varistor or a suppressor is formed. That is, the exemplary embodiment may include: a body; a conductive layer disposed in the body; an external electrode disposed outside the body so as to be connected to the conductive layer; a surface insulation layer formed on the rest surface except for a surface on which the conductive layer is connected to the external electrode; and a coupling layer disposed between an extended area of the external electrode and the surface insulation layer. Here, the conductive layer may be the coil pattern described in the exemplary embodiments, a plurality of internal electrodes of a capacitor, which are spaced a predetermined distance from each other, and a discharge electrode in a varistor or a suppressor. Alternatively, the external electrode may be formed outside the body in which all of the coil pattern, the internal electrode, and the discharge electrode are formed.

Figure 20:
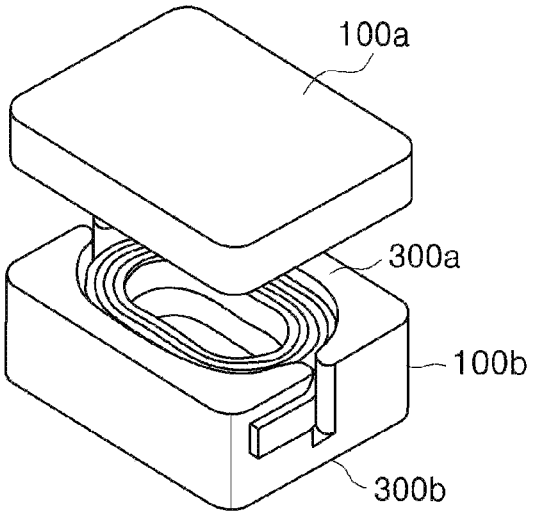
FIGS. 20 to 23 are perspective views and a cross-sectional view for explaining a wound-type inductor in an order of processes in accordance with another exemplary embodiment.
Figure 21:
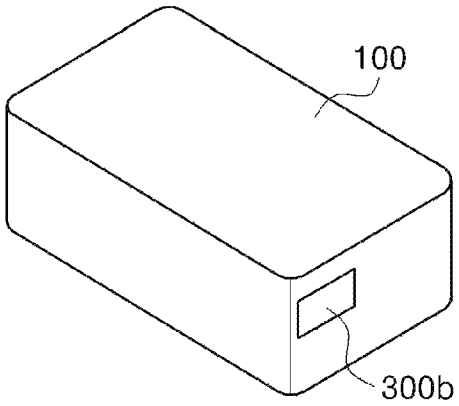
Figure 22:
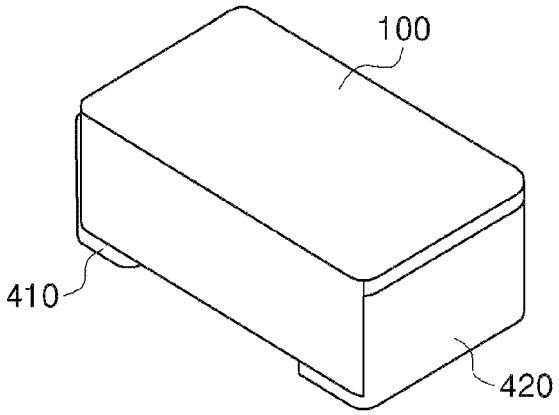
Figure 23:
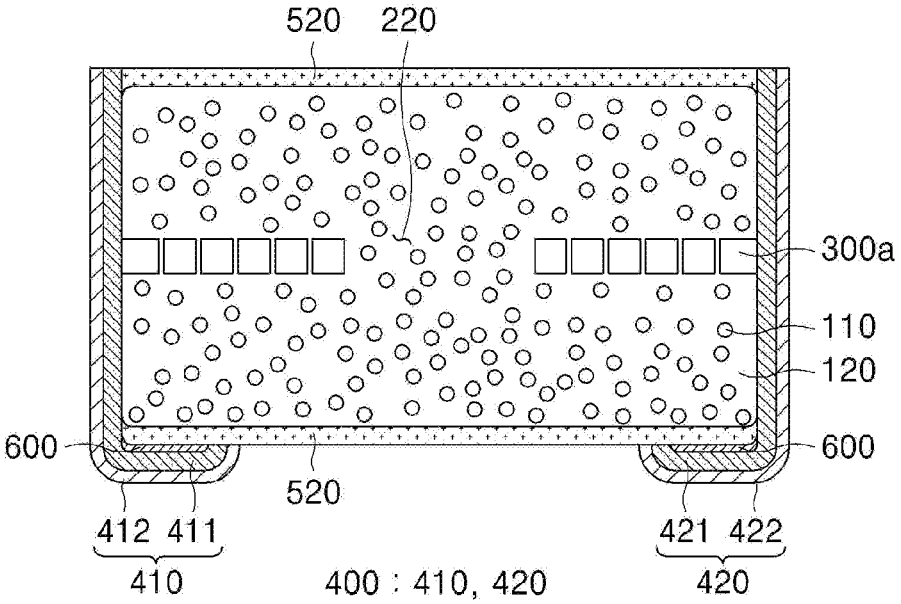

Also, the exemplary embodiments may be applied to an inductor including a wound-type coil formed in a body. That is, as illustrated in FIGS. 20 to 23, the exemplary embodiments may be applied to a wound-type inductor including an external electrode 400 outside a body 100 in which a wound-type coil 300*a* is provided between an upper body 100*a* and a lower body 100*b*, in which metal magnetic powder and epoxy resin are mixed. FIGS. 20 to 22 are perspective views illustrating manufacturing processes in sequence for explaining other exemplary embodiments applied to the wound-type inductor, and FIG. 23 is a cross-sectional view.

As illustrated in FIG. 20, an accommodation part in which the wound-type coil 300*a* is accommodated is defined in the lower body 100*b*, and the upper body 100*a* is disposed above the lower body 100*b* to cover the accommodation part. A withdrawal part 300*b* through which the wound-type coil 300*a* is withdrawn may be defined in an outer surface of the lower body 100*b*. Here, although not shown, the wound-type coil 300*a* and the withdrawal part 300*b* may be coated with an inner insulation layer. As the upper body 100*a* covers and then presses the lower body 100*b*, the body 100 may be filled in a space defined by the wound-type coil 300*a*. For example, the upper body 100*a* may be formed to fill the inner space of the wound-type coil 300*a* and the space between the wound-type coils 300*a* by pressing the body 100.

As illustrated in FIG. 21, the body 100 is polished and resized. That is, the body 100 is resized by polishing four or six surfaces thereof. Here, the withdrawal part of the wound-type coil 300*a* may be partially polished, and thus a thickness thereof may decrease.

As illustrated in FIG. 22, the external electrode 400 may be provided on the withdrawal part 300*a*. Here, the external electrode 400 may extend from a side surface to only a bottom surface of the body 100. That is, the external electrode 400 may have, e.g., a "L"-shape. Alternatively, the external electrode 400 may extend to adjacent four surfaces in addition to the side surface. Here, the surface insulation layer 520 is formed on an area on which the external electrode 400 is not formed, i.e., top and bottom surfaces of the body 100 in the Z-direction, and front and rear surfaces thereof. The coupling layer 600 is formed on the bottom surface of the body 100 in the Z-direction, and then the external electrode 400 is formed on the side surface of the body 100 and the coupling layer 600. Here, the surface insulation layer 520 and the coupling layer 600 may be firstly formed on the upper body 100*a* and the lower body 100*b* before the wound-type coil 300*a* is embedded. That is, the surface insulation layer 510 is formed on an outer surface of the lower body 100*b*, and the coupling layer 600 is formed on a predetermined area thereof. Thereafter, the upper body 100*b* in which the surface insulation layer 510 is formed on an outer surface thereof may be coupled to the lower body 100*b*. Alternatively, the upper body 100*a* and the lower body 100*b* may be coupled to each other, and then the surface insulation layer 510 and the coupling layer 600 may be formed and the external electrode 400 may be formed. FIG. 23 is a cross-sectional view illustrating the wound-type inductor that is manufactured as described above.

Figure 24:
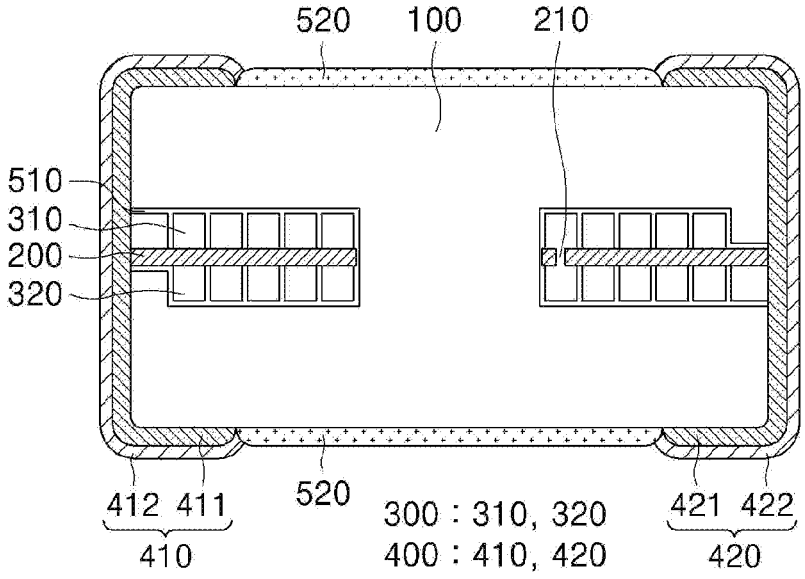
FIGS. 24 to 26 are cross-sectional views of a power inductor in accordance with other exemplary embodiments.
Figure 25:
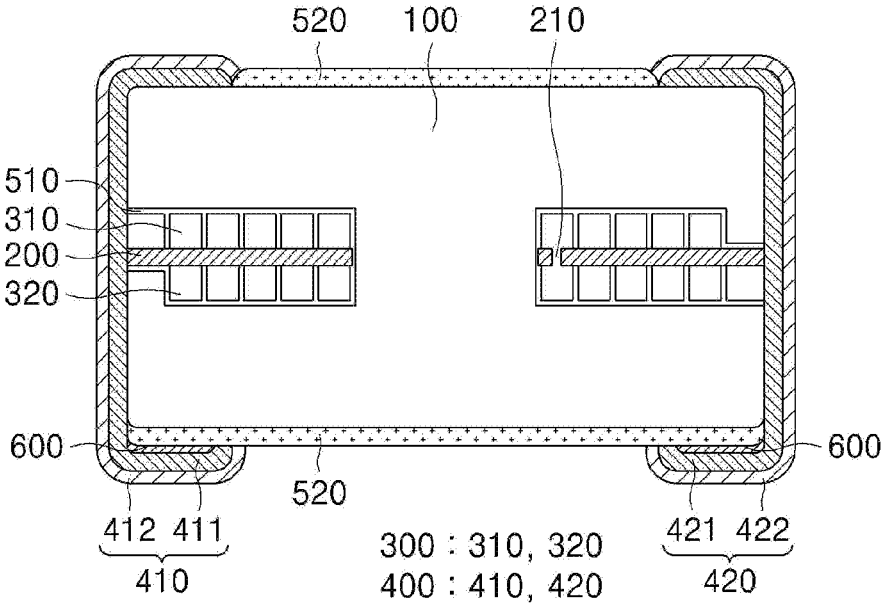
Figure 26:
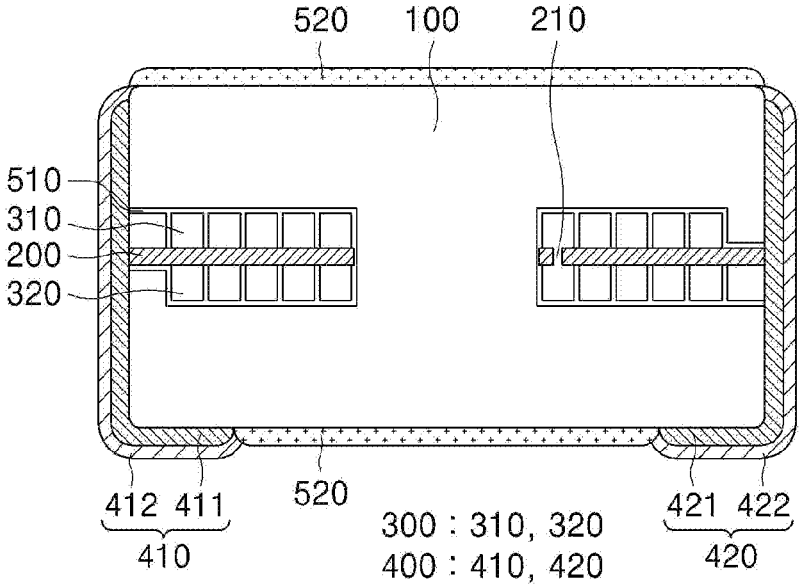

In the power inductor in accordance with exemplary embodiments, the coupling layer 600 may not be formed on at least a portion thereof, and at least a portion of the surface insulation layer 520 may be removed. For example, as illustrated in FIG. 24, the surface insulation layer 520 may not be formed on an area to which the external electrode 400 extends. That is, the surface insulation layer 520 may be formed on only the surface of the body on which the external electrode 400 is not formed. Accordingly, the external electrode 400 and an extended area thereof may contact the surface of the body 100. Also, as illustrated in FIG. 25, the surface insulation layer 520 may not be formed on at least a portion of the area to which the external electrode 400 extends. That is, although the surface insulation layer 520 is formed on one portion of the area to which the external electrode 400 extends, the surface insulation layer 520 may not be formed on the other portion. For example, the surface insulation layer 520 may not be formed on a portion of the top surface of the body 100, to which the external electrode 400 extends and may be formed on a portion including the bottom surface of the body 100, to which the external electrode 400 extends. Thus, one portion of the extended area of the external electrode 400 may contact the surface insulation layer 520, and the other portion may contact the body 100. Here, the coupling layer 600 may be formed between the surface insulation layer 520 and the extended area of the external electrode 400. Also, as illustrated in FIG. 26, the external electrode 400 may not extend to a partial area. That is, even in case of a thin-film-type powder inductor, like the wound-type inductor in FIG. 23, the external electrode 400 may not extend to the top surface of the body 100 and may extend to only an area including the bottom surface of the body 100. Here, the surface insulation layer 520 may be formed on the entire top surface of the body 100, to which the external electrode 400 does not extend and may be formed on an area, on which the external electrode 400 is not formed, including the bottom surface of the body 100 to which the external electrode 400 extends. That is, the surface insulation layer 520 may not be formed on the area on which the external electrode 400 is formed. Thus, the external electrode 400 may contact the surface of the body 100. However, although not shown, the surface insulation layer 520 may be formed on the portion to which the external electrode 400 extends, and the coupling layer 600 may be formed therebetween.

The present invention may, however, be embodied in different forms and should not be construed as limited to the embodiments set forth herein. Therefore, it will be readily understood by those skilled in the art that various modifications and changes can be made thereto without departing from the spirit and scope of the present invention defined by the appended claims.

What is claimed is:

1. A power inductor comprising:

a body having multiple surfaces;

a coil pattern provided in the body;

a surface insulation layer disposed on at least one area of a surface of the body;

an external electrode disposed on at least one surface of the body and extending to at least another surface of the body, which is adjacent to the at least one surface of the body; and a coupling layer provided between the body and an extended area of the external electrode, wherein the coupling layer is disposed between the surface insulation layer and the extended area of the external electrode.

2. The power inductor of claim 1, wherein the body has an inclined edge.

3. The power inductor of claim 1, wherein the coil pattern is connected to the external electrode at the at least one surface and the surface insulation layer is not disposed on the at least one surface at which the coil pattern is connected to the external electrode.

4. The power inductor of claim 1, wherein the coupling layer contains metal or a metal alloy.

5. The power inductor of claim 4, wherein at least a portion of the external electrode contains the same material as at least one of the coil pattern and the coupling layer.

6. The power inductor of claim 4, wherein the external electrode comprises a first layer configured to contact the coil pattern and the coupling layer and at least one second layer disposed on the first layer and made of a material different from the first layer.

7. A method of manufacturing a power inductor, the method comprising:

preparing a body in which a coil pattern is formed;

forming a surface insulation layer on a surface of the body;

forming a coupling layer on a predetermined area on the surface insulation layer;

removing a portion of the coupling layer and the surface insulation layer to expose the coil pattern; and forming an external electrode on at least one surface of the body so that the external electrode is connected to the coil pattern.

8. The method of claim 7, further comprising forming an edge of the body to be inclined before the forming of the surface insulation layer.

9. The method of claim 7, wherein the external electrode extends from at least one surface of the body to at least one surface, which is adjacent thereto, of the body.

10. The method of claim 9, wherein the coupling layer is formed on an extended area of the external electrode.

11. The method of claim 10, wherein at least a portion of the external electrode is formed by using the same material and the same method as at least one of the coil pattern and the coupling layer.

* * * * *